US010253786B2

(12) United States Patent
Hino et al.

(10) Patent No.: US 10,253,786 B2
(45) Date of Patent: Apr. 9, 2019

(54) BLOWER APPARATUS

(71) Applicant: Nidec Corporation, Kyoto (JP)

(72) Inventors: Yuko Hino, Kyoto (JP); Seung-Sin Yoo, Kyoto (JP); Tomoyuki Tsukamoto, Kyoto (JP); Akihiko Makita, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 184 days.

(21) Appl. No.: 15/615,202

(22) Filed: Jun. 6, 2017

(65) Prior Publication Data

US 2017/0356465 A1 Dec. 14, 2017

Related U.S. Application Data

(60) Provisional application No. 62/347,380, filed on Jun. 8, 2016.

(30) Foreign Application Priority Data

Mar. 15, 2017 (JP) ..... 2017-049387

(51) Int. Cl.
*F04D 29/62* (2006.01)
*F04B 35/04* (2006.01)
(Continued)

(52) U.S. Cl.
CPC ..... *F04D 29/626* (2013.01); *F04B 35/04* (2013.01); *F04D 17/161* (2013.01); *F04D 25/06* (2013.01);
(Continued)

(58) Field of Classification Search
CPC .. F04D 29/626; F04D 25/0613; F04D 17/161; F04D 25/06; F04D 29/083;
(Continued)

(56) References Cited

U.S. PATENT DOCUMENTS 3,225,422 A * 12/1965 Sebok ..... B21D 53/267 29/463
3,362,338 A * 1/1968 Stethem ..... F04D 29/2233 416/183
(Continued)

FOREIGN PATENT DOCUMENTS

CN 105022460 A 11/2015
GB 1461776 A * 1/1977 ..... F04D 17/161
(Continued)

OTHER PUBLICATIONS

Office Action dated Oct. 31, 2018, issued in counterpart Chinese application No. 201710418952.9, with English translation. (16 pages).
(Continued)

*Primary Examiner* — Hung Q Nguyen
(74) *Attorney, Agent, or Firm* — Westerman, Hattori, Daniels & Adrian

(57) ABSTRACT

This blower apparatus includes an air blowing portion including a plurality of flat plates arranged with an axial gap defined between adjacent ones of the flat plates; a motor portion arranged to rotate the air blowing portion; and a housing arranged to house the air blowing portion and the motor portion. The housing includes an air inlet and an air outlet. At least one of the flat plates includes, in at least one of an upper surface and a lower surface thereof, a plurality of guide portions each of which is a protruding portion or recessed portion arranged to extend in a radial direction. An air flow traveling radially outward is generated between the flat plates by viscous drag of surfaces of the flat plates and a centrifugal force. Since the air flow is generated between the flat plates, the air flow does not easily leak upwardly or downwardly.

14 Claims, 15 Drawing Sheets

(51) Int. Cl.
*F04D 25/06* (2006.01)
*F04D 29/08* (2006.01)
*F04D 17/16* (2006.01)
*F04B 17/00* (2006.01)

(52) U.S. Cl.
CPC ..... *F04D 25/0613* (2013.01); *F04D 29/083* (2013.01); *F04B 17/00* (2013.01)

(58) Field of Classification Search
CPC .... F04D 29/046; F04D 29/047; F04D 29/049; F04D 29/063; F04D 29/263; F04D 29/30; F04B 35/04; F04B 17/00
USPC ..... 416/182–186 R
See application file for complete search history.

(56) References Cited

U.S. PATENT DOCUMENTS 4,065,233 A * 12/1977 Torigoe ..... F04D 25/082 415/208.3
4,253,798 A * 3/1981 Sugiura ..... F04D 29/2255 415/204
4,255,081 A * 3/1981 Oklejas ..... F04D 17/161 415/90
4,428,717 A * 1/1984 Catterfeld ..... F04D 7/04 29/889.4
4,940,385 A * 7/1990 Gurth ..... F04D 5/001 415/206
8,523,539 B2 * 9/2013 Gill ..... F04D 5/001 384/280
9,846,462 B2 12/2017 Chen et al.
2002/0195886 A1 12/2002 Collins et al.
2006/0051205 A1 * 3/2006 Platz ..... F04D 29/4233 415/206
2014/0212303 A1 * 7/2014 Tamaoka ..... F04D 29/0513 417/354
2017/0300094 A1 * 10/2017 Delano ..... F04D 29/281

FOREIGN PATENT DOCUMENTS

JP 55087893 A * 7/1980 ..... F04D 29/24
JP 2008-88985 A 4/2008

OTHER PUBLICATIONS

Related co-pending U.S. Appl. No. 15/608,270, filed May 30, 2017, counterpart Japanese Patent Application No. 2017-049380.
Related co-pending U.S. Appl. No. 15/608,321, filed May 30, 2017, counterpart Japanese Patent Application No. 2017-049381.
Related co-pending U.S. Appl. No. 15/615,115, filed Jun. 6, 2017, counterpart Japanese Patent Application No. 2017-049382.
Related co-pending U.S. Appl. No. 15/608,366, filed May 30, 2017, counterpart Japanese Patent Application No. 2017-049383.
Related co-pending U.S. Appl. No. 15/608,446, filed May 30, 2017, counterpart Japanese Patent Application No. 2017-049384.
Related co-pending U.S. Appl. No. 15/608,482, filed May 30, 2017, counterpart Japanese Patent Application No. 2017-049385.
Related co-pending U.S. Appl. No. 15/615,143, filed Jun. 6, 2017, counterpart Japanese Patent Application No. 2017-049386.
Related co-pending U.S. Appl. No. 15/615,234, filed Jun. 6, 2017, counterpart Japanese Patent Application No. 2017-049388.
Related co-pending U.S. Appl. No. 15/615,279, filed Jun. 6, 2017, counterpart Japanese Patent Application No. 2017-049389.
Related co-pending U.S. Appl. No. 15/615,316, filed Jun. 6, 2017, counterpart Japanese Patent Application No. 2017-049390.

* cited by examiner

BLOWER APPARATUS

BACKGROUND OF THE INVENTION

1. Field of the Invention

The present invention relates to a blower apparatus.

2. Description of the Related Art

A centrifugal blower apparatus which generates an air flow traveling radially outward by rotating an impeller including a plurality of blades is known. A known blower apparatus including an impeller is described in, for example, JP-A 2008-88985.

In the blower apparatus described in JP-A 2008-88985, a plurality of blades referred to as fan blades push surrounding gas to generate air flows traveling radially outward.

SUMMARY OF THE INVENTION

In recent years, there has still been a demand for reductions in the size and thickness of electronic devices. Accordingly, there has also been a demand for a reduction in the thickness of blower apparatuses used to cool the interiors of the electronic devices.

Here, in the case where an impeller is used to generate air flows, as in the blower apparatus described in JP-A 2008-88985, air flows pushed by a blade leak from axially upper and lower ends of the blade while the impeller is rotating. As a result, air pressure is lower at the axially upper and lower ends of the blade than in the vicinity of an axial middle of the blade. Accordingly, a reduction in the thickness of the blower apparatus, which involves a reduction in the axial dimension of the impeller, will result in a failure to secure sufficient air blowing efficiency.

An object of the present invention is to provide a technique for realizing a centrifugal blower apparatus which is excellent in air blowing efficiency.

A blower apparatus according to a preferred embodiment of the present invention includes an air blowing portion arranged to rotate about a central axis extending in a vertical direction; a motor portion arranged to rotate the air blowing portion; and a housing arranged to house the air blowing portion and the motor portion. The housing includes an air inlet arranged above the air blowing portion, and arranged to pass through a portion of the housing in an axial direction; and an air outlet arranged to face in a radial direction at at least one circumferential position radially outside of the air blowing portion. The air blowing portion includes a plurality of flat plates arranged in the axial direction with an axial gap defined between adjacent ones of the flat plates. At least one of the flat plates includes, in at least one of an upper surface and a lower surface thereof, a plurality of guide portions spaced from one another in a circumferential direction. Each of the guide portions is a protruding portion or recessed portion arranged to extend in a radial direction.

According to the above preferred embodiment of the present invention, once the air blowing portion starts rotating, an air flow traveling radially outward is generated in the axial gap between the adjacent ones of the flat plates by viscous drag of surfaces of the flat plates and a centrifugal force. Thus, gas supplied through the air inlet and an air hole travels radially outwardly of the air blowing portion. Since the air flow is generated between the flat plates, the air flow does not easily leak, upwardly or downwardly, and thus, an improvement in air blowing efficiency is achieved. In addition, the guide portions in the surface of the flat plate(s) contribute to a further improvement, in the air blowing efficiency. Accordingly, a reduced thickness of the blower apparatus according to the above preferred embodiment of the present invention does not result in a significant reduction in the air blowing efficiency. In addition, the blower apparatus according to the above preferred embodiment of the present invention is superior to a comparable centrifugal fan including an impeller in terms of being silent.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, blower apparatuses according to preferred embodiments of the present invention will be described. It is assumed herein that a side on which an upper plate portion is arranged with respect to a lower plate portion is an upper side, and the shape of each member or portion and relative positions of different members or portions will be described based on the above assumption. It should be noted, however, that the above definition of the upper and lower sides is not meant to restrict in any way the orientation of a blower apparatus according to any preferred embodiment of the present invention at the time of manufacture or when in use.

1. First Preferred Embodiment

1-1. Structure of Blower Apparatus

Figure 1:
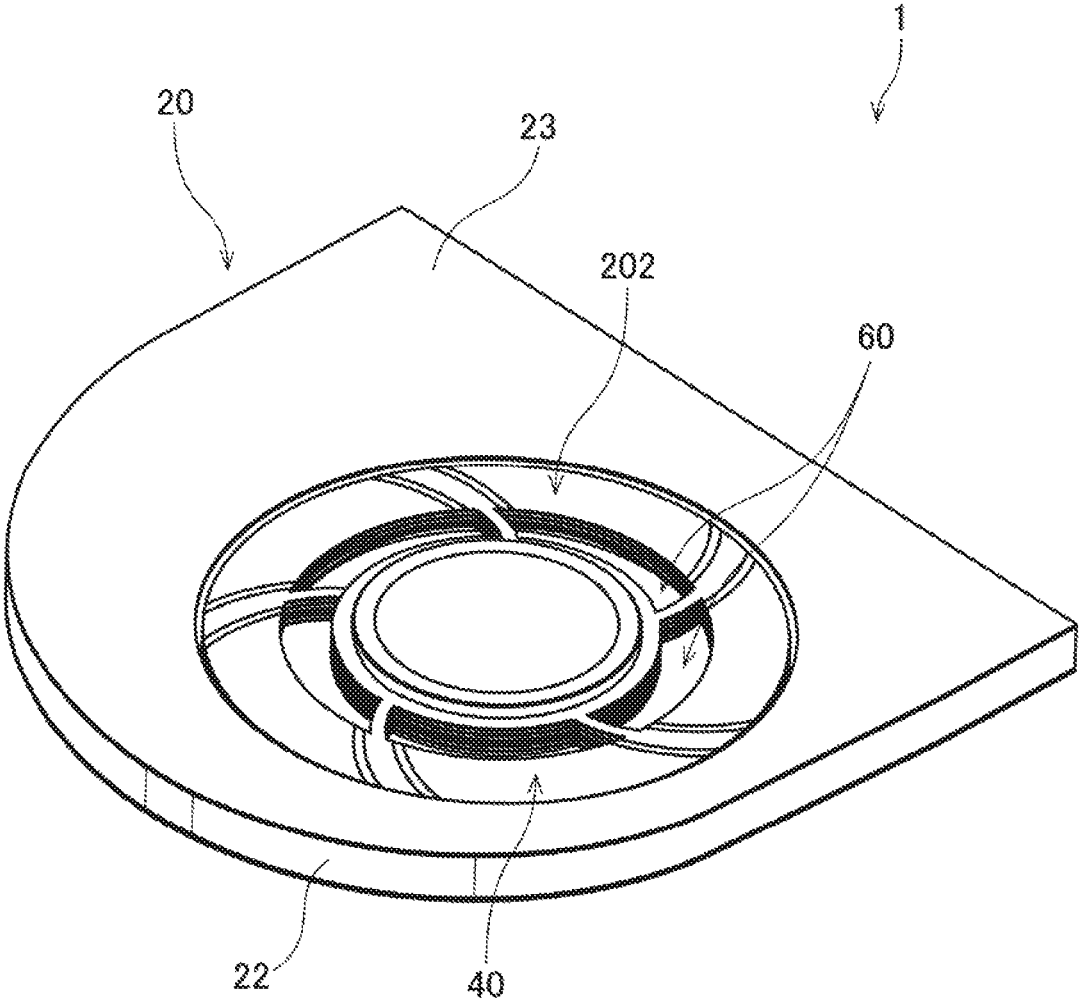
FIG. 1 is a perspective view of a blower apparatus according to a first preferred embodiment of the present invention.
Figure 2:
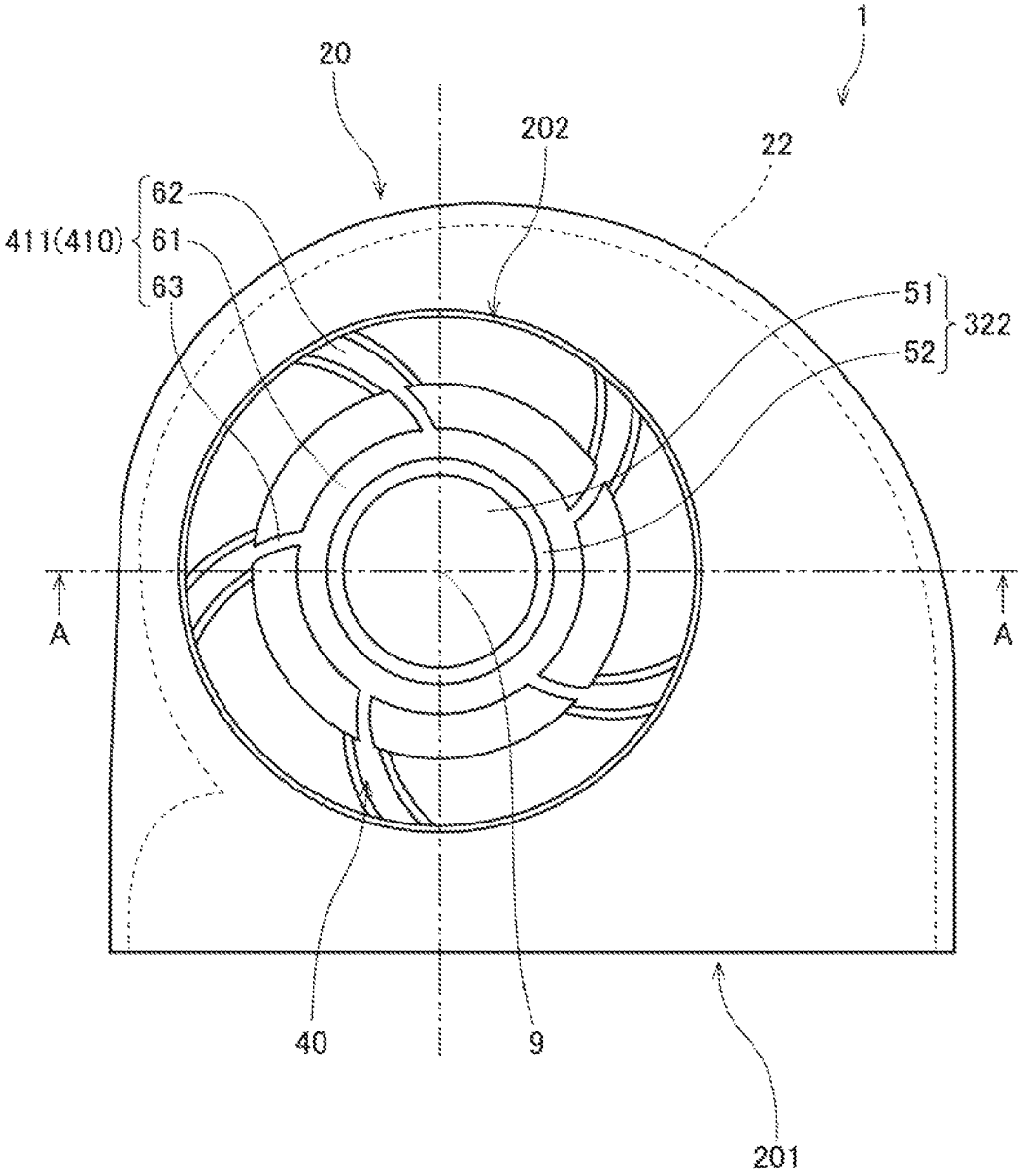
FIG. 2 is a top view of the blower apparatus according to the first, preferred embodiment.
Figure 3:
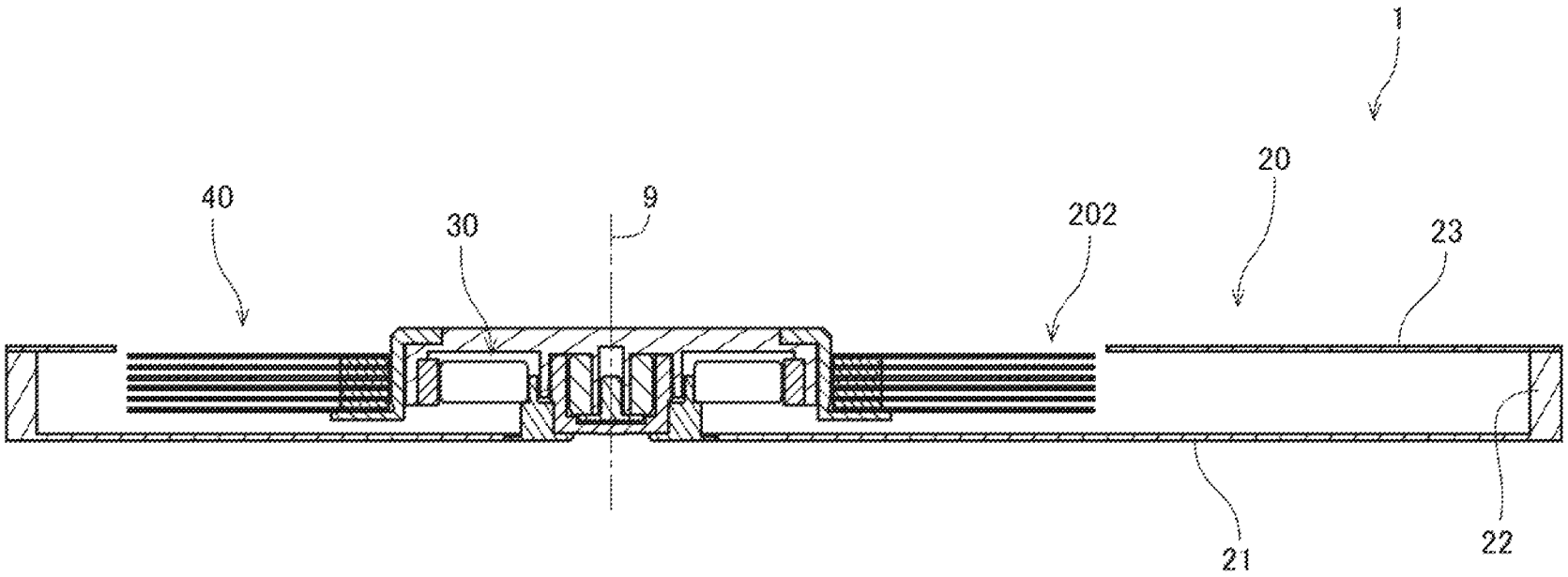
FIG. 3 is a sectional view of the blower apparatus according to the first preferred embodiment.
Figure 4:
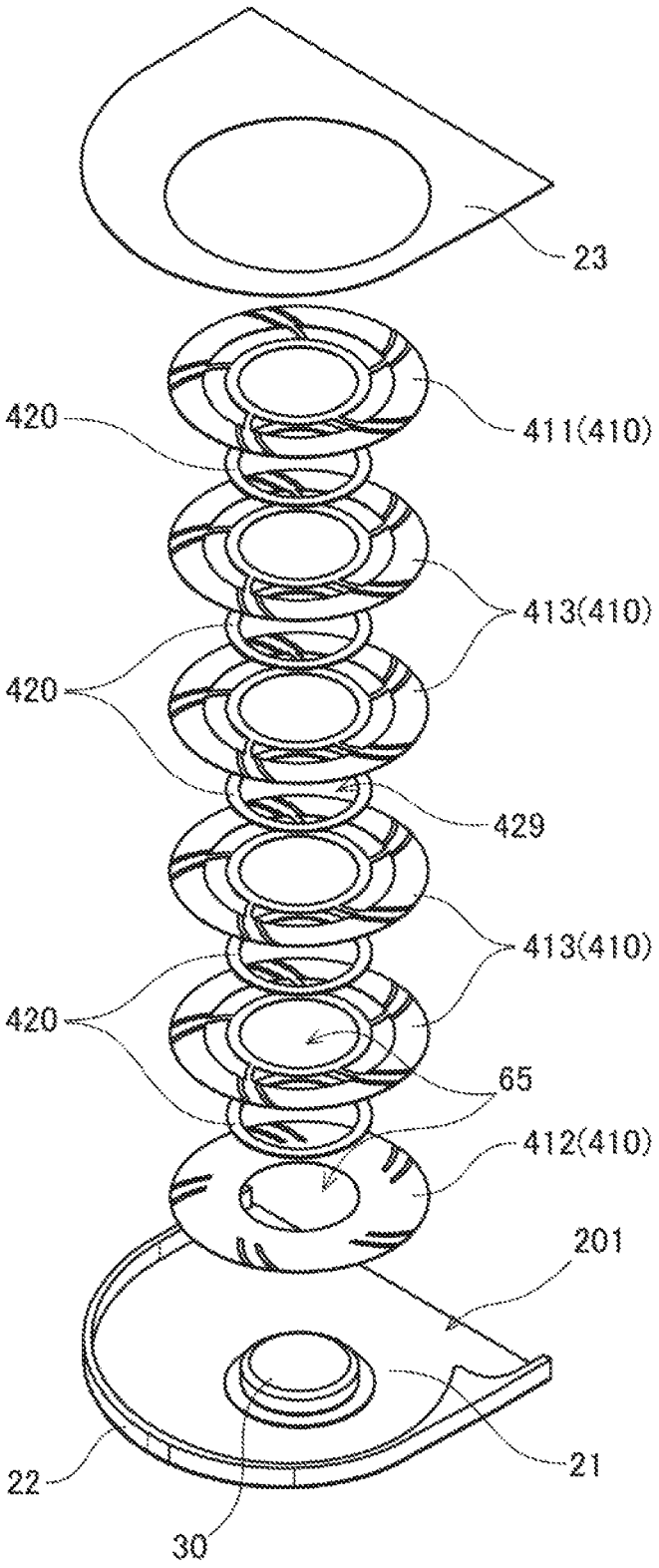
FIG. 4 is an exploded perspective view of the blower apparatus according to the first preferred embodiment.
Figure 5:
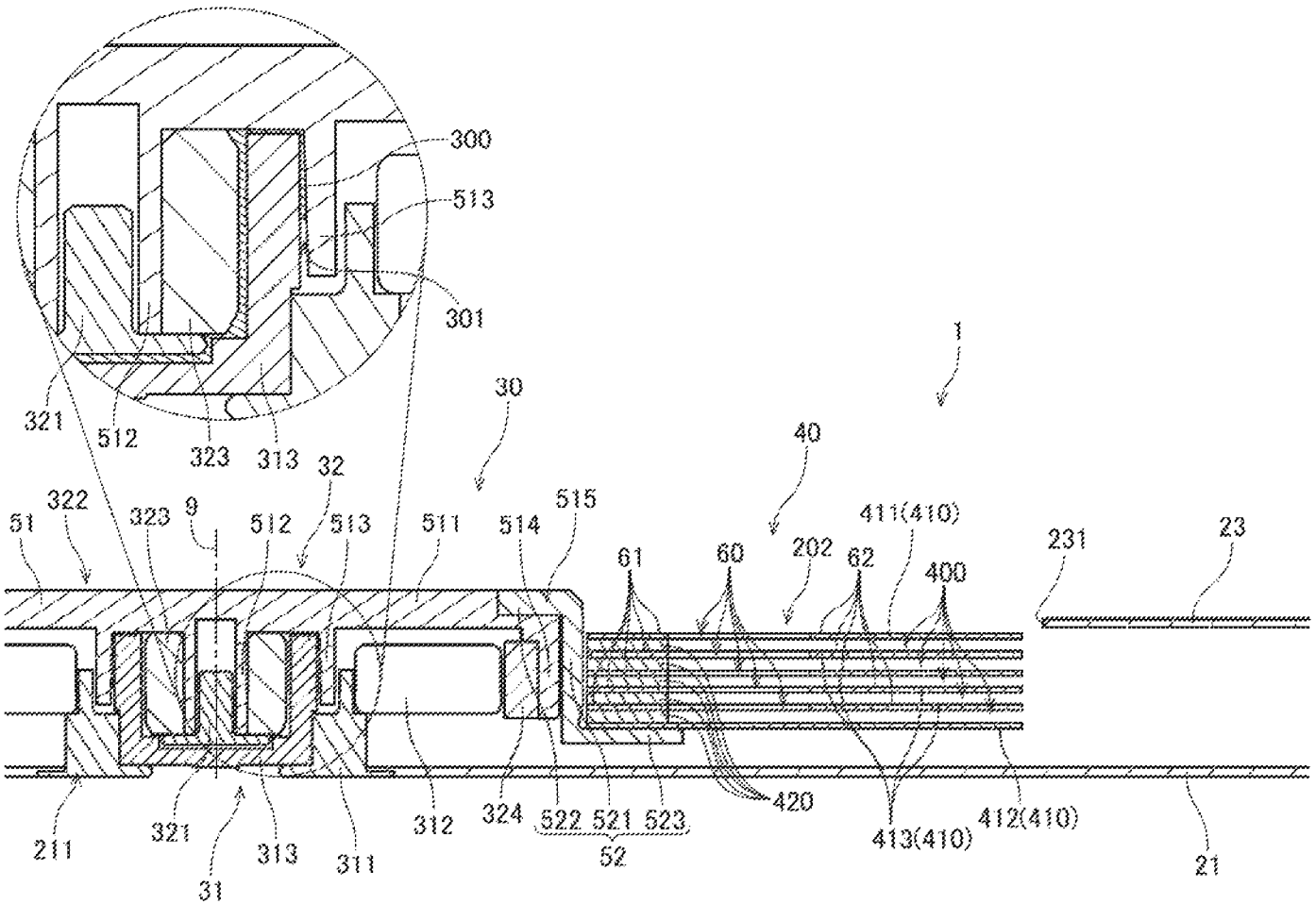
FIG. 5 is a partial sectional view of the blower apparatus according to the first preferred embodiment.

FIG. 1 is a perspective view of a blower apparatus 1 according to a first preferred embodiment of the present invention. FIG. 2 is a top view of the blower apparatus 1. FIG. 3 is a sectional view of the blower apparatus 1 taken along line A-A in FIG. 2. FIG. 4 is an exploded perspective view of the blower apparatus 1. FIG. 5 is a partial sectional view of the blower apparatus 1. The blower apparatus 1 is a centrifugal blower apparatus designed to generate an air flow traveling radially outward by rotating an air blowing portion 40. The blower apparatus 1 is, for example, installed in an electronic device, such as, for example, a personal computer, to cool an interior thereof. Note that blower apparatuses according to preferred embodiments of the present invention may be used for other purposes.

Referring to FIGS. 1 to 4, the blower apparatus 1 includes a housing 20, a motor portion 30, and the air blowing portion 40.

The housing 20 is a case arranged to house the motor portion 30 and the air blowing portion 40. The housing 20 includes a lower plate portion 21, a side wall portion 22, and an upper plate portion 23.

The lower plate portion 21 is arranged to define a bottom portion of the housing 20. The lower plate portion 21 is arranged to extend radially below the air blowing portion 40 to cover at least a portion of a lower side of the air blowing portion 40. In addition, the lower plate portion 21 is arranged to support the motor portion 30.

The side wall portion 22 is arranged to extend upward from the lower plate portion 21. The side wall portion 22 is arranged to cover a lateral side of the air blowing portion 40 between the lower plate portion 21 and the upper plate portion 23. In addition, the side wall portion 22 includes an air outlet 201 arranged to face in a radial direction at one circumferential position. In the present preferred embodiment, the lower plate portion 21 and the side wall portion 22 are defined integrally with each other. Note that the lower plate portion 21 and the side wall portion 22 may alternatively be defined by separate members.

The upper plate portion 23 is arranged to define a cover portion of the housing 20. The upper plate portion 23 is arranged to extend radially above the lower plate portion 21. In addition, the upper plate portion 23 includes an air inlet 202 arranged to pass therethrough in an axial direction. In other words, the upper plate portion 23 includes an inner edge portion 231 arranged to define the air inlet 202. The air inlet 202 is, for example, circular and is centered on a central axis 9 in a plan view.

The motor portion 30 is a driving portion arranged to rotate the air blowing portion 40. Referring to FIG. 5, the motor portion 30 includes a stationary portion 31 and a rotating portion 32. The stationary portion 31 is fixed to the lower plate portion 21. The stationary portion 31 is thus arranged to be stationary relative to the housing 20. The rotating portion 32 is supported to be rotatable about the central axis 9 with respect to the stationary portion 31.

The stationary portion 31 includes a stator fixing portion 311, a stator 312, and a bearing housing 313.

The stator fixing portion 311 is fitted in a fixing hole 211 defined in the lower plate portion 21. As a result, the stator fixing portion 311 is fixed to the lower plate portion 21. The stator fixing portion 311 is arranged to extend upward from the fixing hole 211 to assume a cylindrical shape with the central axis 9 as a center thereof. The stator 312 is fixed to an outer circumferential portion of an upper portion of the stator fixing portion 311.

The stator 312 is an armature arranged to generate magnetic flux in accordance with electric drive currents supplied from an external source. The stator 312 is arranged to annularly surround the central axis 9, which extends in a vertical direction. The stator 312 includes, for example, an annular stator core defined by laminated steel sheets, and conducting wires wound around the stator core.

The bearing housing 313 is a member being cylindrical and having a closed bottom. Specifically, the bearing housing 313 includes a disk-shaped bottom portion, and a cylindrical portion arranged to extend upward from the bottom portion. The bearing housing 313 is fixed to an inner circumferential surface of the stator fixing portion 311.

The rotating portion 32 includes a shaft 321, a hub 322, a bearing member 323, and a magnet 324.

The shaft 321 is a member arranged to extend along the central axis 9. The shaft 321 according to the present preferred embodiment includes a columnar portion arranged inside of a first cylindrical portion 512, which will be described below, and arranged to extend with the central axis 3 as a center thereof, and a disk-shaped portion arranged to extend radially from a lower end portion of the columnar portion.

The hub 322 is fixed to the shaft 321. The hub 322 is made up of a hub body member 51 and a flange member 52.

The hub body member 51 includes a first top plate portion 511, the first cylindrical portion 512, a second cylindrical portion 513, and a magnet holding portion 514.

The first top plate portion 511 is a disk-shaped portion arranged to extend radially with the central axis 9 as a center thereof. The first, top plate portion 511 is arranged above the stator 312. The first top plate portion 511 has a recessed portion 515 recessed from an upper surface thereof at an outer edge portion thereof.

The first cylindrical portion 512 is arranged to extend downward from the first top plate portion 511 to assume a cylindrical shape with the central axis 9 as a center thereof. The columnar portion of the shaft 321 is housed in the first cylindrical portion 512. In addition, the shaft 321 is fixed to the first cylindrical portion 512.

The second cylindrical portion 513 is arranged to extend downward from the first top plate portion 511 to assume a cylindrical shape with the central axis 9 as a center thereof. The second cylindrical portion 513 is arranged to have an inside diameter greater than an outside diameter of the first cylindrical portion 512. In other words, the second cylindrical portion 513 is arranged radially outside of the first cylindrical portion 512.

The magnet holding portion 514 is arranged to extend downward from a radially outer end of the first top plate portion 511 to assume a cylindrical shape with the central axis 9 as a center thereof. The magnet holding portion 514 is arranged radially outside of the stator 312. The magnet 324 is fixed to an inner circumferential surface of the magnet holding portion 514.

The flange member 52 includes an outer wall portion 521, a second top plate portion 522, and a flat plate holding portion 523.

The outer wall portion 521 is a cylindrical portion arranged to extend in the vertical direction with the central axis 9 as a center thereof. The outer wall portion 521 is arranged to extend along an outer circumferential surface of the magnet holding portion 514 of the hub body member 51.

The second top plate portion 522 is arranged to extend radially inward from an upper end portion of the outer wall portion 521 to assume the shape of a circular ring. The second top plate portion 522 is arranged in the recessed portion 515, which is defined in the upper surface of the first top plate portion 511 of the hub body member 51. In addition, the upper surface of the first top plate portion 511 and an upper surface of the second top plate portion 522 are arranged at the same axial position.

The flat plate holding portion 523 is arranged to extend radially outward from a lower end portion of the outer wall portion 521. The flat plate holding portion 523 is arranged to hold the air blowing portion 40 on a radially outer side of the magnet holding portion 514 of the hub body member 51. In the present preferred embodiment, the air blowing portion 40 is mounted on an upper surface of the flat plate holding portion 523. The flat plate holding portion 523 is thus arranged to hold a plurality of flat plates 410 included in the air blowing portion 40.

The bearing member 323 is a cylindrical member arranged to extend in the vertical direction with the central axis 9 as a center thereof. The bearing member 323 is arranged to extend along an outer circumferential surface of the first cylindrical portion 512 of the hub body member 51. In addition, the bearing member 323 is fixed to the outer circumferential surface of the first-cylindrical portion 512. The cylindrical portion of the bearing housing 313 is arranged radially outside of the bearing member 323 and radially inside of the second cylindrical portion 513 of the hub body member 51.

The magnet 324 is fixed to the inner circumferential surface of the magnet holding portion 514 of the hub body member 51. In addition, the magnet 324 is arranged radially outside of the stator 312. The magnet 324 according to the present preferred embodiment is in the shape of a circular ring. A radially inner surface of the magnet 324 is arranged radially opposite to the stator 312 with a slight gap therebetween. In addition, an inner circumferential surface of the magnet 324 includes north and south poles arranged to alternate with each other in a circumferential direction. Note that a plurality of magnets may be used in place of the magnet. 324 in the shape of a circular ring. In the case where the plurality of magnets are used, the magnets are arranged in the circumferential direction such that north and south poles of the magnets alternate with each other.

As illustrated in an enlarged view in FIG. 5, a lubricating fluid 300 is arranged between the bearing housing 313 and a combination of the shaft 321, the bearing member 323, and the hub body member 51. A polyolester oil or a diester oil, for example, is used as the lubricating fluid 300. The shaft 321, the hub 322, and the bearing member 323 are supported to be rotatable with respect to the bearing housing 313 through the lubricating fluid 300. Thus, in the present preferred embodiment, the bearing housing 313, which is a component of the stationary portion 31, the combination of the shaft 321, the bearing member 323, and the hub body member 51, each of which is a component of the rotating portion 32, and the lubricating fluid 300 together define a fluid dynamic bearing.

A surface of the lubricating fluid 300 is defined in a seal portion 301, which is a gap between an outer circumferential surface of the bearing housing 313 and an inner circumferential surface of the second cylindrical portion 513 of the hub body member 51. In the seal portion 301, the distance between the outer circumferential surface of the bearing housing 313 and the inner circumferential surface of the second cylindrical portion 513 is arranged to increase with decreasing height. In other words, in the seal portion 301, the distance between the outer circumferential surface of the bearing housing 313 and the inner circumferential surface of the second cylindrical portion 513 is arranged to increase with increasing distance from the surface of the lubricating fluid 300. Since the radial width of the seal portion 301 thus increases with decreasing height, the lubricating fluid 300 is attracted upward in the vicinity of the surface of the lubricating fluid 300. This reduces the likelihood that the lubricating fluid 300 will leak out of the seal portion 301.

Use of the fluid dynamic bearing as a bearing mechanism that connects the stationary portion 31 and the rotating portion 32 allows the rotating portion 32 to rotate stably. Thus, the likelihood of an occurrence of an unusual sound from the motor portion 30 can be reduced.

Once electric drive currents are supplied to the stator 312 in the motor portion 30 as described above, magnetic flux is generated around the stator 312. Then, interaction between the magnetic flux of the stator 312 and magnetic flux of the magnet 324 produces a circumferential torque between the stationary portion 31 and the rotating portion 32, so that the rotating portion 32 is caused to rotate about the central axis 9 with respect to the stationary portion 31. The air blowing portion 40, which is held by the flat plate holding portion 523 of the rotating portion 32, is caused to rotate about the central axis 9 together with the rotating portion 32.

Preferring to FIGS. 4 and 5, the air blowing portion 40 includes the plurality of flat plates 410 and a plurality of spacers 420. The flat, plates 410 and the spacers 420 are arranged to alternate with each other in the axial direction. In addition, adjacent ones of the flat, plates 410 and the spacers 420 are fixed to each other through, for example, adhesion.

Referring to FIGS. 4 and 5, in the present preferred embodiment, the flat plates 410 include a top flat plate 411, which is arranged at the highest position, a bottom flat plate 412, which is arranged at the lowest position, and four intermediate flat plates 413, which are arranged below the top flat plate 411 and above the bottom flat plate 412. That is, the number of flat plates 410 included in the air blowing portion 40 according to the present preferred embodiment is six. The flat plates 410 are arranged in the axial direction with an axial gap 400 defined between adjacent ones of the flat plates 410.

Each flat plate 410 is made of, for example, a metal material, such as stainless steel, or a resin material. Each flat plate 410 may alternatively be made of, for example, paper. In this case, paper including a glass fiber, a metal wire, or the like in addition to plant fibers may be used. The flat plate 410 is able to achieve higher dimensional accuracy when the flat plate 410 is made of a metal material than when the flat plate 410 is made of a resin material.

In the present preferred embodiment, each of the top flat plate 411 and the four intermediate flat plates 413 is arranged to have the same shape and size. Referring to FIGS. 1, 2, and 5, each of the top flat plate 411 and the intermediate flat plates 413 includes an inner annular portion 61, an outer annular portion 62, a plurality of ribs 63, and a plurality of air holes 60. In the present preferred embodiment, the number of ribs 63 and the number of air holes 60 included in each of the top flat plate 411 and the intermediate flat plates 413 are both five. Each air hole 60 is arranged to be in communication with a space radially outside of the air blowing portion 40 through the axial gap(s) 400 adjacent to the flat plate 410 including the air hole 60 on the upper and/or lower sides of the flat plate 410. Each air hole 60 is arranged at a position overlapping with the air inlet 202 of the housing 20 when viewed in the axial direction.

The bottom flat plate 412 is an annular and plate-shaped member centered on the central axis 9. The bottom flat plate 412 has a central hole 65 arranged to pass therethrough in the vertical direction in a center thereof. The shape of each flat plate 410 will be described in detail below.

Referring to FIG. 4, each spacer 420 is a member in the shape of a circular ring. The spacers 420 are arranged between the flat plates 410 to secure the axial gaps 400 between the flat plates 410. Each spacer 420 has a central hole 429 arranged to pass therethrough in the vertical direction in a center thereof. The motor portion 30 is arranged in the central holes 65, which will be described below, of the flat plates 410 and the central holes 429 of the spacers 420.

Each spacer 420 is arranged at a position axially coinciding with the inner annular portion 61 of each of the top flat plate 411 and the intermediate flat plates 413. Thus, the spacer 420 is arranged in a region in the corresponding axial gap 400, the region covering only a portion of the radial extent of the corresponding axial gap 400.

Once the motor portion 30 is driven, the air blowing portion 40 is caused to rotate together with the rotating portion 32. As a result, viscous drag of a surface of each flat plate 410 and a centrifugal force together generate an air flow traveling radially outward in the vicinity of the surface of the flat plate 410. Thus, an air flow traveling radially outward is generated in each of the axial gaps 400 between the flat plates 410. Thus, gas above the housing 20 is supplied to each axial gap 400 through the air inlet 202 of the housing 20 and the air holes 60 of the top flat plate 411 and the intermediate flat plates 413, and is discharged out of the blower apparatus 1 through the air outlet 201, which is defined in a side portion of the housing 20.

Here, each flat plate 410 is arranged to have an axial thickness of about 0.1 mm. Meanwhile, each axial gap 400 is arranged to have an axial dimension of about 0.3 mm. The axial dimension of the axial gap 400 is preferably in the range of 0.2 mm to 0.5 mm. An excessively large axial dimension of the axial gap 400 would lead to a separation between an air flow generated by a lower surface of the flat plate 410 on the upper side and an air flow generated by an upper surface of the flat plate 410 on the lower side during rotation of the air blowing portion 40. This separation could result in a failure to generate sufficient static pressure in the axial gap 400 to discharge a sufficient volume of air. Moreover, an excessively large axial dimension of the axial gap 400 would make it difficult to reduce the axial dimension of the blower apparatus 1. Accordingly, in this blower apparatus 1, the axial dimension of the axial gap 400 is arranged to be in the range of 0.2 mm to 0.5 mm. This arrangement allows the blower apparatus 1 to achieve a reduced thickness while allowing an increase in the static pressure in the axial gap 400 to discharge a sufficient volume of air.

In addition, referring to FIG. 2, the air inlet 202 is centered on the central axis 9. That is, a center of the air inlet 202 coincides with the central axis 9. Meanwhile, the air blowing portion 40 is also centered on the central axis 9. Accordingly, differences in pressure do not easily occur at different circumferential positions in the air blowing portion 40. This contributes to reducing noise. It is assumed that the term "coincide" as used here includes not only "completely coincide" but also "substantially coincide".

1-2. Shapes of Flat Plates

Figure 6:
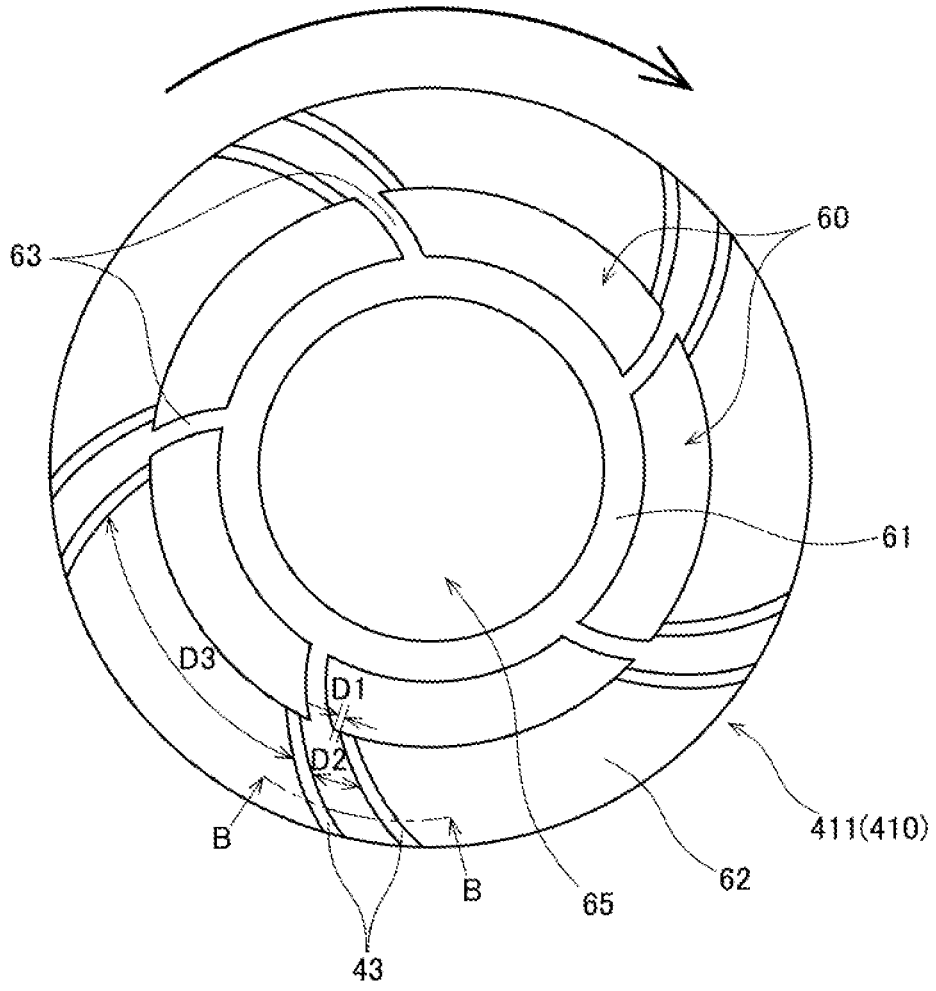
FIG. 6 is a fop view of a plurality of flat plates of the blower apparatus according to the first preferred embodiment.
Figure 7:
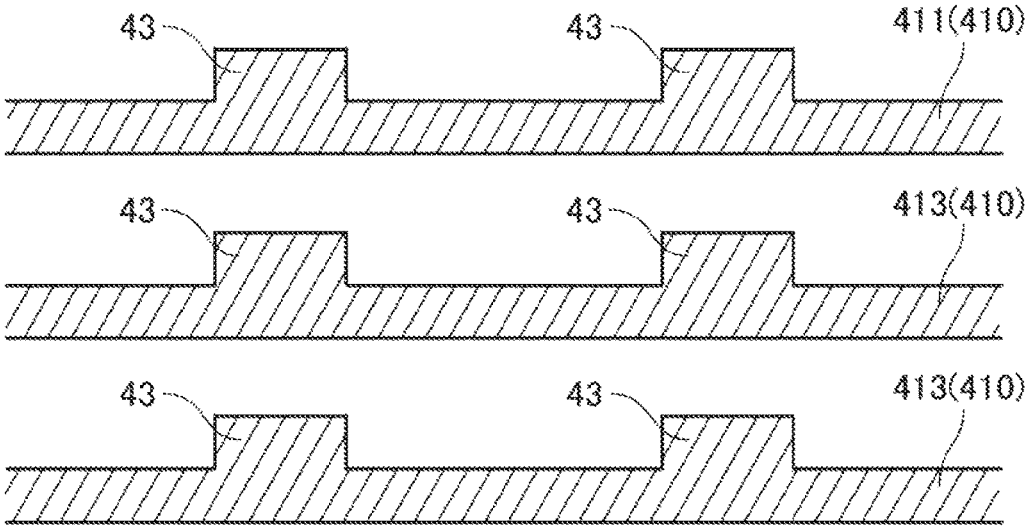
FIG. 7 is a partial sectional view of some of the flat plates according to the first preferred embodiment.

Next, the shape of each flat plate 410 will now be described in detail below with reference to FIGS. 4, 6, and 7. FIG. 6 is a top view of the flat plates 410. FIG. 7 is a partial sectional view of the flat plates 410 taken along line B-B in FIG. 6.

Referring to FIG. 4, in the present preferred embodiment, each of the top flat plate 411 and the four intermediate flat plates 413 is arranged to have the same shape and size. As described above, each of the top flat plate 411 and the intermediate flat plates 413 includes the inner annular portion 61, the outer annular portion 62, the plurality of ribs 63, and the plurality of air holes 60.

The inner annular portion 61 is an annular portion centered on the central axis 9. The inner annular portion 61 has a central hole 65 arranged to pass therethrough in the vertical direction in a center thereof. The outer annular portion 62 is an annular portion arranged radially outside of the inner annular portion 61 with the central axis 9 as a center thereof. Each rib 63 is arranged to join the inner annular portion 61 and the outer annular portion 62 to each other. Each air hole 60 is arranged to pass through the flat plate 410 in the axial direction. Each air hole 60 is surrounded by the inner annular portion 61, the outer annular portion 62, and two circumferentially adjacent ones of the ribs 63.

In a related-art blower apparatus that generates air flows by rotating an impeller including a plurality of blades, air flows generated by the impeller leak at upper and lower end portions of the impeller. This leakage of the air flows occurs regardless of the axial dimension of the blower apparatus. Therefore, as the blower apparatus is designed to be thinner, an effect of this leakage on the blower apparatus as a whole becomes greater, resulting in lower air blowing efficiency. Meanwhile, in the blower apparatus 1 according to the present preferred embodiment, the air flows are generated in the vicinity of the surfaces of the flat plates 410, and therefore, the air flows do not easily leak upward or downward. Therefore, even when the axial dimension of the air blowing portion 40, which generates the air flow's, is reduced, a reduction in air blowing efficiency due to leakages of the air flows does not easily occur. That is, even when the blower apparatus 1 has a reduced thickness, a reduction in air blowing efficiency thereof does not easily occur.

In addition, in a blower apparatus including an impeller, periodic noise occurs owing to the shape, number, arrangement, and so on of blades. However, this blower apparatus 1 is superior to a comparable blower apparatus including an impeller in terms of being silent, because the air flows are generated by the viscous drag of the surface of each flat plate 410 and the centrifugal force in the blower apparatus 1.

In addition, from the viewpoint of P-Q characteristics (i.e., flow rate-static pressure characteristics), the blower apparatus 1 including the flat plates 410 is able to produce a higher static pressure in a low flow rate region than the blower apparatus including the impeller. Therefore, when compared to the blower apparatus including the impeller, the blower apparatus 1 is suitable for use in a densely packed case, from which only a relatively small volume of air can be discharged. Examples of such cases include cases of electronic devices, such as, for example, personal computers.

In the present preferred embodiment, the top flat plate 411 and all the intermediate flat plates 413 include the air holes 60. Accordingly, all the axial gaps 400 are in axial communication with a space above the housing 20 through the air inlet 202 and the air holes 60.

Each of the top flat plate 411 and the intermediate flat plates 413 includes the air holes 60. Accordingly, in each of the top flat plate 411 and the intermediate flat plates 413, the outer annular portion 62, which is arranged radially outside of the air holes 60, defines an air blowing region which generates an air flow in the vicinity of a surface thereof. Meanwhile, the bottom flat plate 412 includes no air hole 60. Therefore, in an upper surface of the bottom flat plate 412, an entire region radially outside of a portion of the bottom flat plate 412 which makes contact with the spacer 420 defines an air blowing region. In other words, in the upper surface of the bottom flat plate 412, a region which axially coincides with the air holes 60 and the ribs 63 of the top flat plate 411 and the intermediate flat plates 413, and a region which axially coincides with the outer annular portions 62 thereof, together define the air blowing region. In addition, in a lower surface of the bottom flat plate 412, an entire region radially outside of a portion of the bottom flat plate 412 which makes contact with the flat plate holding portion 523 defines an air blowing region. Notice that an air flow is generated by a lower surface of the flat plate holding portion 523 as well.

As described above, the bottom flat plate 412 has air blowing regions wider than the air blowing regions of the top flat plate 411 and the intermediate flat plates 413. Therefore, the axial gap 400 between the lowest one of the intermediate flat plates 413 and the bottom flat plate 412 is able to have higher static pressure than any other axial gap 400.

Air flows passing downward through the air inlet 202 and the air holes 60 are drawn radially outward in each axial gap 400. Therefore, the air flows passing through the air holes 60 become weaker as they travel downward. In the present preferred embodiment, the bottom flat plate 412 is arranged to have an air blowing region wider than the air blowing regions of the top flat plate 411 and the intermediate flat plates 413 to cause a stronger air flow to be generated in the lowest one of the axial gaps 400 than in any other axial gap 400 to cause the air flows passing downward through the air holes 60 to be drawn toward the lowest axial gap 400. Thus, a sufficient volume of gas is supplied to the lowest axial gap 400 as well. As a result, the air blowing portion 40 achieves improved air blowing efficiency.

In this blower apparatus 1, each of the flat plates 410 includes, in the upper surface thereof, a plurality of guide portions 43 spaced from one another in the circumferential direction. Referring to FIG. 7, each of the guide portions 43 is a protruding portion defined in the upper surface of the corresponding flat plate 410. Notice that, in FIG. 7, sections of the top flat plate 411 and two of the intermediate flat plates 413 are shown. When at least one of the flat plates 410 includes the guide portions 43, an air flow traveling radially outward and generated in the vicinity of the surface of the flat plate 410 is guided in a desired direction without an occurrence of an eddy. This leads to an improvement in the air blowing efficiency of the blower apparatus 1.

Note that, although each of the flat plates 410 includes the guide portions 43 in this blower apparatus 1, this is not essential to the present invention. Alternatively, only some of the flat plates 410 may include the guide portions 43. Also note that it is sufficient if the guide portions 43 are defined in at least one of the upper and lower surfaces of the flat plate(s). That is, the guide portions 43 may be defined in the lower surface of the corresponding flat plate 410 or in both the upper and lower surfaces of the corresponding flat plate 410. Also note that, although each of the guide portions 43 is a protruding portion defined in the surface of the corresponding flat plate 410 in this blower apparatus 1, this is not essential to the present invention. The guide portion 43 may alternatively be a recessed portion defined in the surface of the corresponding flat plate 410.

In this blower apparatus 1, all the flat plates 410 include the guide portions 43. Accordingly, the air flows generated in the vicinity of the surfaces of the flat plates 410 are guided in a desired direction in all of the axial gaps 400. This leads to a further improvement in the air blowing efficiency of the blower apparatus 1.

In each of the top flat plate 411 and the intermediate flat plates 413, each of the guide portions 43 is arranged to extend over the entire radial extent of the outer annular portion 62 thereof. Thus, the air flow can be guided over the entire radial extent of the outer annular portion 62, which defines the air blowing region radially outside of the air holes 60. In addition, in the bottom flat plate 412, each of the guide portions 43 is arranged to extend over the same radial range as the guide portions 43 of the top flat plate 411 and the intermediate flat plates 413. Note that, in the bottom flat plate 412, each of the guide portions 43 may alternatively be arranged to extend into a radial range over which the air holes 60 of the top flat plate 411 and the intermediate flat plates 413 are arranged.

In this blower apparatus 1, the flat plates 410 are arranged to rotate to one side in the circumferential direction along with rotation of the motor portion 30. Referring to FIG. 6, each of the guide portions 43 is arranged to curve to an opposite side in the circumferential direction as the guide portion 43 extends radially outward. As a result, the guide portion 43 extends along a direction of an air flow that passes near the surface of the flat plate 410. The guide portion 43 is thus able to guide the air flow near the flat plate 410 in an appropriate direction without disturbing the air flow. This leads to an improvement in the air blowing efficiency of the blower apparatus 1. Note that each guide portion 43 may alternatively be arranged to extend in a straight line in a radial direction, or to extend in a straight line and to be inclined to the opposite side in the circumferential direction as it extends radially outward.

Referring to FIG. 6, each of the ribs 63 is arranged to curve to the opposite side in the circumferential direction as the rib 63 extends radially outward. As a result, the rib 63 extends along the direction of the air-flow that passes near the surface of the flat plate 410. This contributes to preventing the rib 63 from disturbing the air flow near the flat plate 410. This contributes to reducing the likelihood that a turbulent flow will occur near the rib 63. This leads to an improvement in the air blowing efficiency of the blower apparatus 1. Note that each rib 63 may alternatively be arranged to extend in a straight line in a radial direction, or to extend in a straight line and to be inclined to the opposite side in the circumferential direction as it extends radially outward.

In this blower apparatus 1, each guide portion 43 is arranged to extend in the radial direction with a curvature equal to a curvature with which each rib 63 is arranged to extend in the radial direction. It is assumed here that the term "equal" includes "substantially equal". When the curvature of the guide portion 43 and the curvature of the rib 63 are arranged to be equal to each other as described above, the direction of an air flow near the rib 63 and the direction of the air flow near the guide portion 43 substantially correspond with each other. This contributes to preventing a turbulent flow from occurring in the vicinity of the guide portion 43, which leads to an improvement in the air blowing efficiency of the blower apparatus 1.

Referring to FIG. 6, radially inner end portions of two of the guide portions 43 are arranged on both circumferential sides of a radially outer end of each rib 63. A circumferential distance D1 between the radially outer end of each rib 63 and a radially inner end of each of the guide portions 43 circumferentially adjacent to the rib 63 is arranged to be smaller than circumferential distances D2 and D3 between radially inner ends of every two circumferentially adjacent ones of the guide portions 43. When the guide portions 43 are arranged in the vicinity of each rib 63, an air flow traveling radially outward from the vicinity of the rib 63 can be guided effectively. This contributes to more effectively preventing a turbulent flow from occurring in the vicinity of the rib 63, which leads to a further improvement in the air blowing efficiency of the blower apparatus 1.

2. Example Modifications

While a preferred embodiment of the present invention has been described above, it is to be understood that the present invention is not limited to the above-described preferred embodiment.

Figure 8:
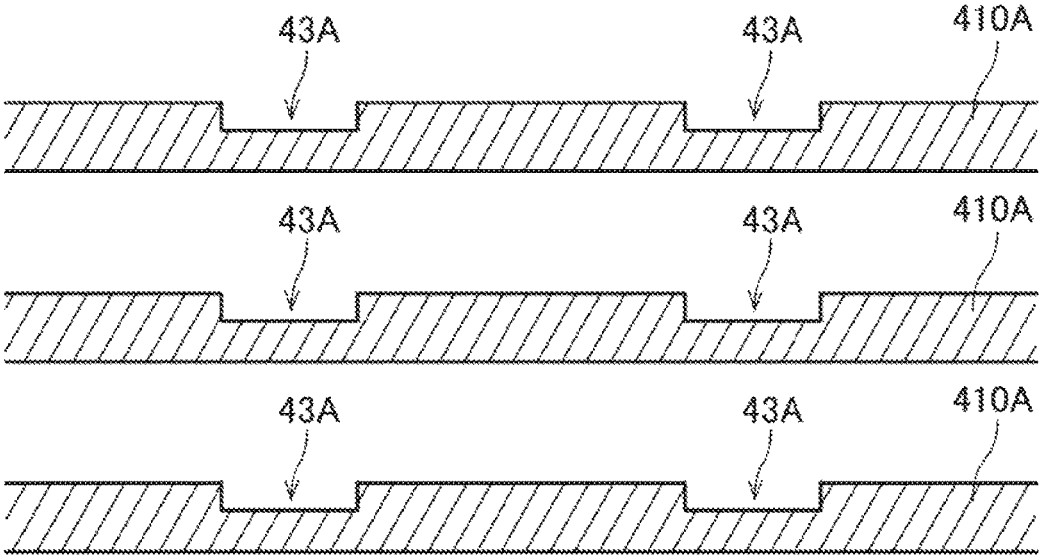
FIG. 8 is a partial sectional view of a plurality of flat plates of a blower apparatus according to a modification of the first preferred embodiment.

FIG. 8 is a partial sectional view of a plurality of flat plates 410A of a blower apparatus according to a modification of the above-described preferred embodiment. In FIG. 8, sections of three of the flat plates 410A are shown. In the blower apparatus according to the modification illustrated in FIG. 8, each of the flat plates 410A includes, in an upper surface thereof, a plurality of guide portions 43A spaced from one another in the circumferential direction. Each of the guide portions 43A is a recessed portion defined in the upper surface of the corresponding flat plate 410A.

Figure 9:
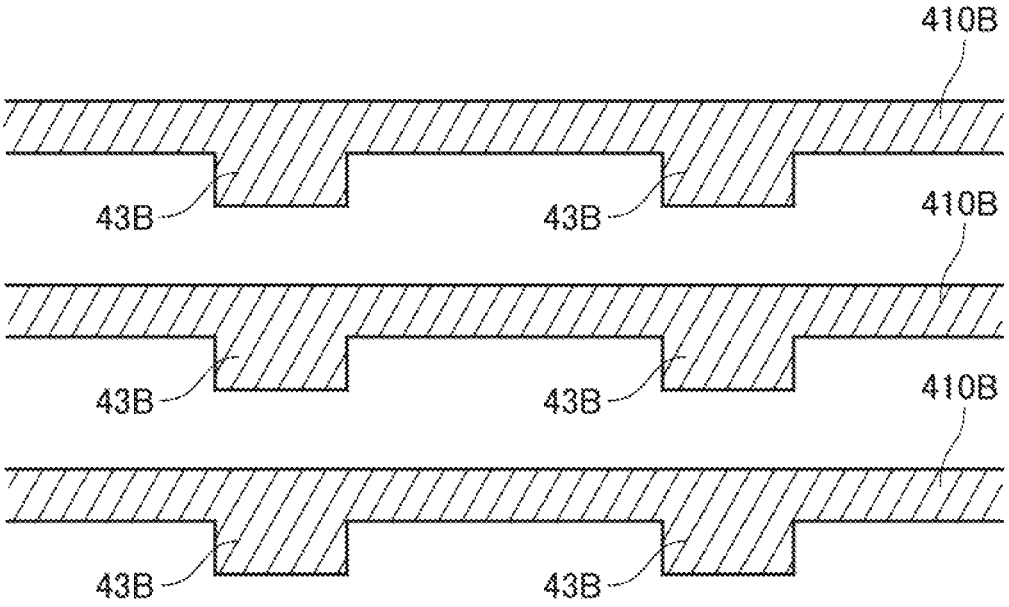
FIG. 9 is a partial sectional view of a plurality of flat plates of a blower apparatus according to a modification of the first preferred embodiment.

FIG. 9 is a partial sectional view of a plurality of flat plates 410B of a blower apparatus according to another modification of the above-described preferred embodiment. In FIG. 9, sections of three of the flat plates 410B are shown. In the blower apparatus according to the modification illustrated in FIG. 9, each of the flat plates 410B includes, in a lower surface thereof, a plurality of guide portions 43B spaced from one another in the circumferential direction. Each of the guide portions 43B is a protruding portion defined in the lower surface of the corresponding flat plate 410B.

Figure 10:
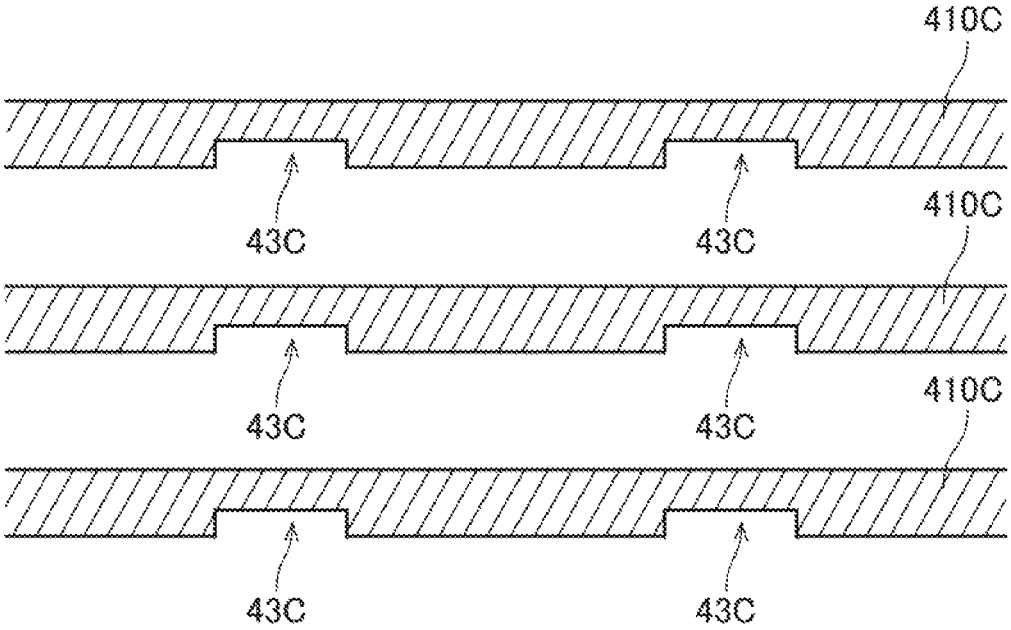
FIG. 10 is a partial sectional view of a plurality of flat plates of a blower apparatus according to a modification of the first preferred embodiment.

FIG. 10 is a partial sectional view of a plurality of flat plates 410C of a blower apparatus according to yet another modification of the above-described preferred embodiment. In FIG. 10, sections of three of the flat plates 410C are shown. In the blower apparatus according to the modification illustrated in FIG. 10, each of the flat plates 410C includes, in a lower surface thereof, a plurality of guide portions 43C spaced from one another in the circumferential direction. Each of the guide portions 43C is a recessed portion defined in the lower surface of the corresponding flat plate 410C.

It is sufficient if the guide portions are defined in at least one of the upper surface and the lower surface of the corresponding flat plate as in each of the modifications illustrated in FIGS. 8 to 10. That is, the guide portions may be defined in only the upper surface of the corresponding flat plate, or in only the lower surface of the corresponding flat plate. Also, it is sufficient if the guide portions are protruding portions and/or recessed portions defined in the surface of the corresponding flat plate. The guide portions are able to guide an air flow generated in the vicinity of the surface of the flat plate including the guide portions in a desired direction, regardless of whether the guide portions are protruding portions or recessed portions. An improvement in the air blowing efficiency can accordingly be achieved.

Figure 11:
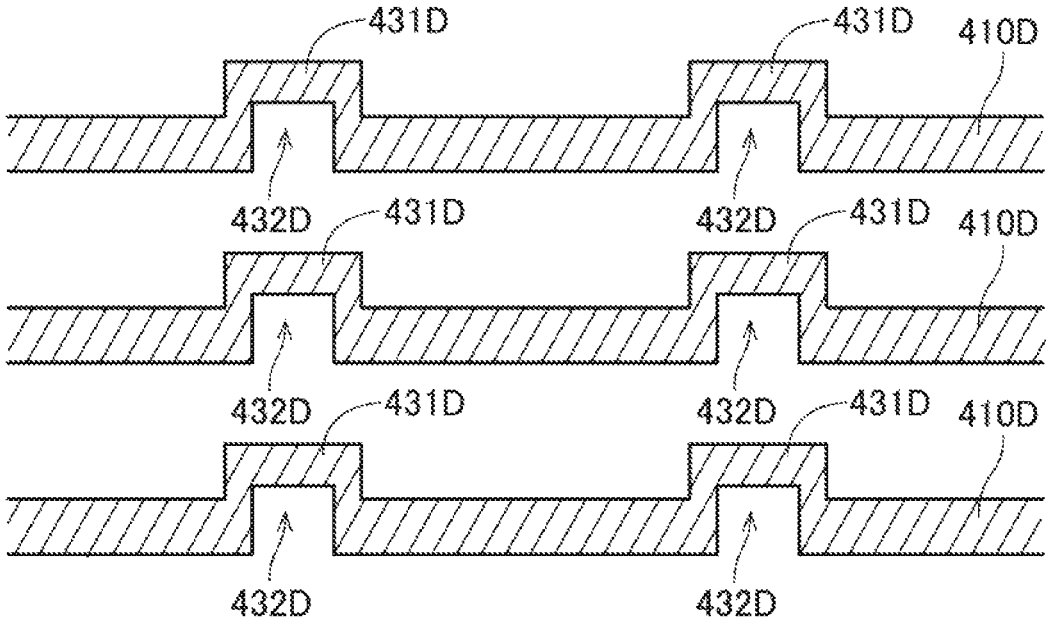
FIG. 11 is a partial sectional view of a plurality of flat plates of a blower apparatus according to a modification of the first preferred embodiment.

FIG. 11 is a partial sectional view of a plurality of flat plates 410D of a blower apparatus according to yet another modification of the above-described preferred embodiment. In FIG. 11, sections of three of the flat plates 410D are shown. In the blower apparatus according to the modification illustrated in FIG. 11, each of the flat plates 410D includes a plurality of first guide portions 431D in an upper surface thereof, and includes a plurality of second guide portions 432D in a lower surface thereof. In addition, each first guide portion 431D is a protruding portion, while each second guide portion 432D is a recessed portion. Farther, the first guide portions 431D and the second guide portions 432D are arranged to axially overlap with each other.

In the blower apparatus according to the modification illustrated in FIG. 11, the guide portions 431D and 432D are defined in both the upper and lower surfaces of the corresponding flat plate 410D. Thus, air flows generated in the vicinity of the surface of the flat plate 410D can be guided on both the upper and lower sides of the flat plate 410D. A further improvement in the air blowing efficiency can accordingly be achieved.

In addition, in the modification illustrated in FIG. 11, each flat plate 410D is arranged to have a substantially uniform axial thickness with the first guide portions 431D, which are the protruding portions, and the second guide portions 432D, which are the recessed portions, being arranged to axially overlap with each other. Simply defining the protruding portions in the surface of the flat plate 410D would result in an increased weight of the flat plate 410D. Meanwhile, simply defining the recessed portions in the surface of the flat plate 410D would result in a reduction in rigidity of the flat plate 410D at the recessed portions. Accordingly, in the modification illustrated in FIG. 11, the axial thickness of each flat plate 410D is arranged to be substantially uniform to prevent or reduce an increase in the weight of the flat plate 410D and prevent or reduce a reduction in the rigidity of the flat plate 410D while allowing the air flow's to be guided more effectively.

Figure 12:
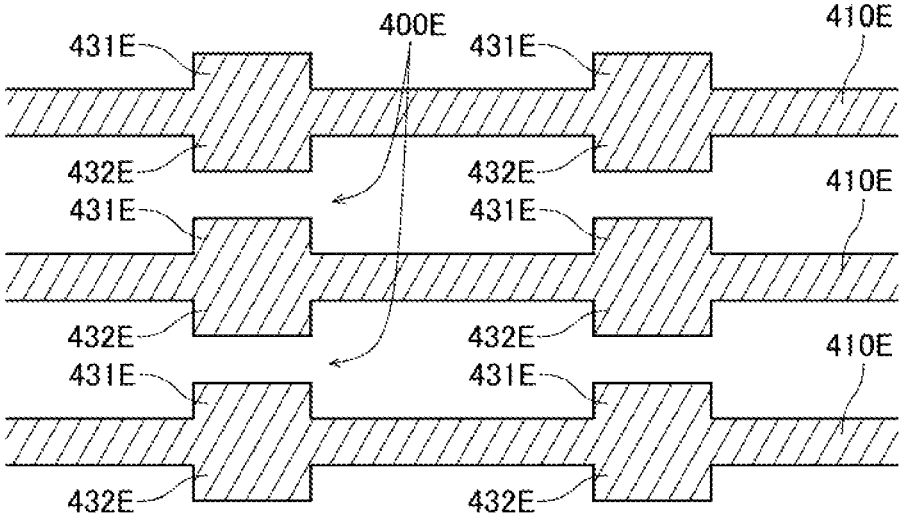
FIG. 12 is a partial sectional view of a plurality of flat plates of a blower apparatus according to a modification of the first preferred embodiment.

FIG. 12 is a partial sectional view of a plurality of flat plates 410E of a blower apparatus according to yet another modification of the above-described preferred embodiment. In FIG. 12, sections of three of the flat plates 410E are shown. In the blower apparatus according to the modification illustrated in FIG. 12, each of the flat plates 410E includes a plurality of first guide portions 431E in an upper surface thereof, and includes a plurality of second guide portions 432E in a lower surface thereof. Each of the first guide portions 431E and the second guide portions 432E is a protruding portion. In addition, the first guide portions 431E and the second guide portions 432E are arranged to axially overlap with each other.

In the blower apparatus according to the modification illustrated in FIG. 12, in an axial gap 400E defined between adjacent ones of the flat plates 410E, a flow channel extending in a radial direction is defined by two circumferentially adjacent ones of the second guide portions 432E of the flat plate 410E on the upper side and two circumferentially adjacent ones of the first guide portions 431E of the flat plate 410E on the lower side. Thus, air flows generated in the vicinity of the surfaces of the flat plates can be more effectively guided in a desired direction. A further improvement, in the air blowing efficiency can accordingly be achieved.

Figure 13:
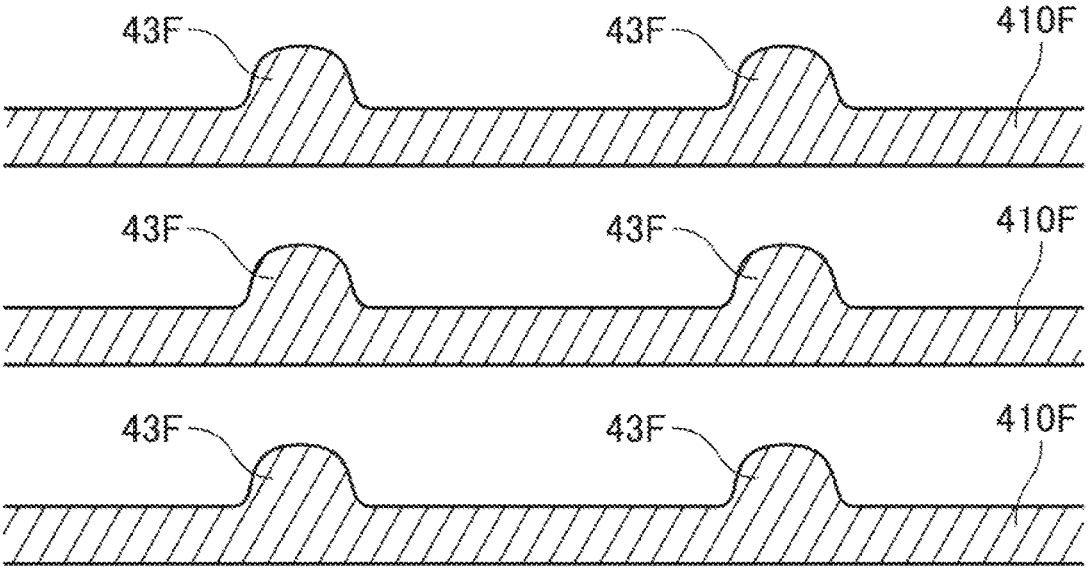
FIG. 13 is a partial sectional view of a plurality of flat plates of a blower apparatus according to a modification of the first preferred embodiment.

FIG. 13 is a partial sectional view of a plurality of flat plates 410F of a blower apparatus according to yet another modification of the above-described preferred embodiment. In FIG. 13, sections of three of the flat plates 410F are shown. In the blower apparatus according to the modification illustrated in FIG. 13, each of the flat plates 410F includes, in an upper surface thereof, a plurality of guide portions 43F spaced from one another in the circumferential direction. Each of the guide portions 43F is a protruding portion defined in the upper surface of the corresponding flat plate 410F.

In the blower apparatus according to the modification illustrated in FIG. 13, a surface of each guide portion 43F is arranged to be curved in a cross-section perpendicular to the length of the guide portion 43F. If the guide portion 43F included an angled portion, an eddy might occur in an air flow at the angled portion, which might cause noise. Accordingly, the surface of the guide portion 43F is arranged to be curved to reduce noise generated in the blower apparatus.

Figure 14:
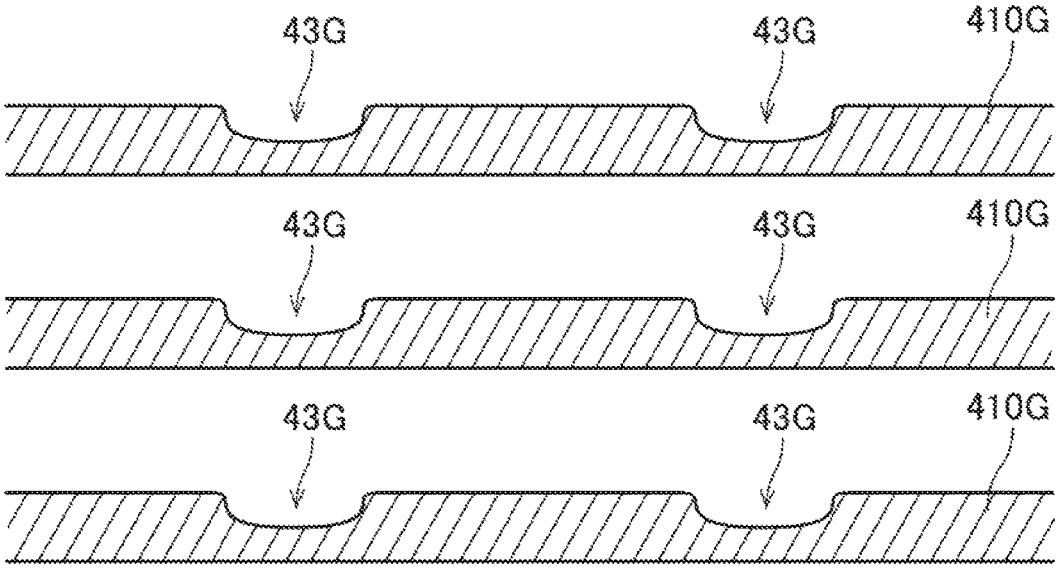
FIG. 14 is a partial sectional view of a plurality of flat plates of a blower apparatus according to a modification of the first preferred embodiment.

FIG. 14 is a partial sectional view of a plurality of flat plates 410G of a blower apparatus according to yet another modification of the above-described preferred embodiment. In FIG. 14, sections of three of the flat plates 410G are shown. In the blower apparatus according to the modification illustrated in FIG. 14, each of the flat plates 410G includes, in an upper surface thereof, a plurality of guide portions 43G spaced from one another in the circumferential direction. Each of the guide portions 43G is a recessed portion defined in the upper surface of the corresponding flat plate 410G.

In the blower apparatus according to the modification illustrated in FIG. 14, a surface of each guide portion 43G is arranged to be curved in a cross-section perpendicular to the length of the guide portion 43G. Thus, the surface of the guide portion 43G is arranged to be curved to reduce noise generated in the blower apparatus, as is similarly the case with the modification illustrated in FIG. 13.

Figure 15:
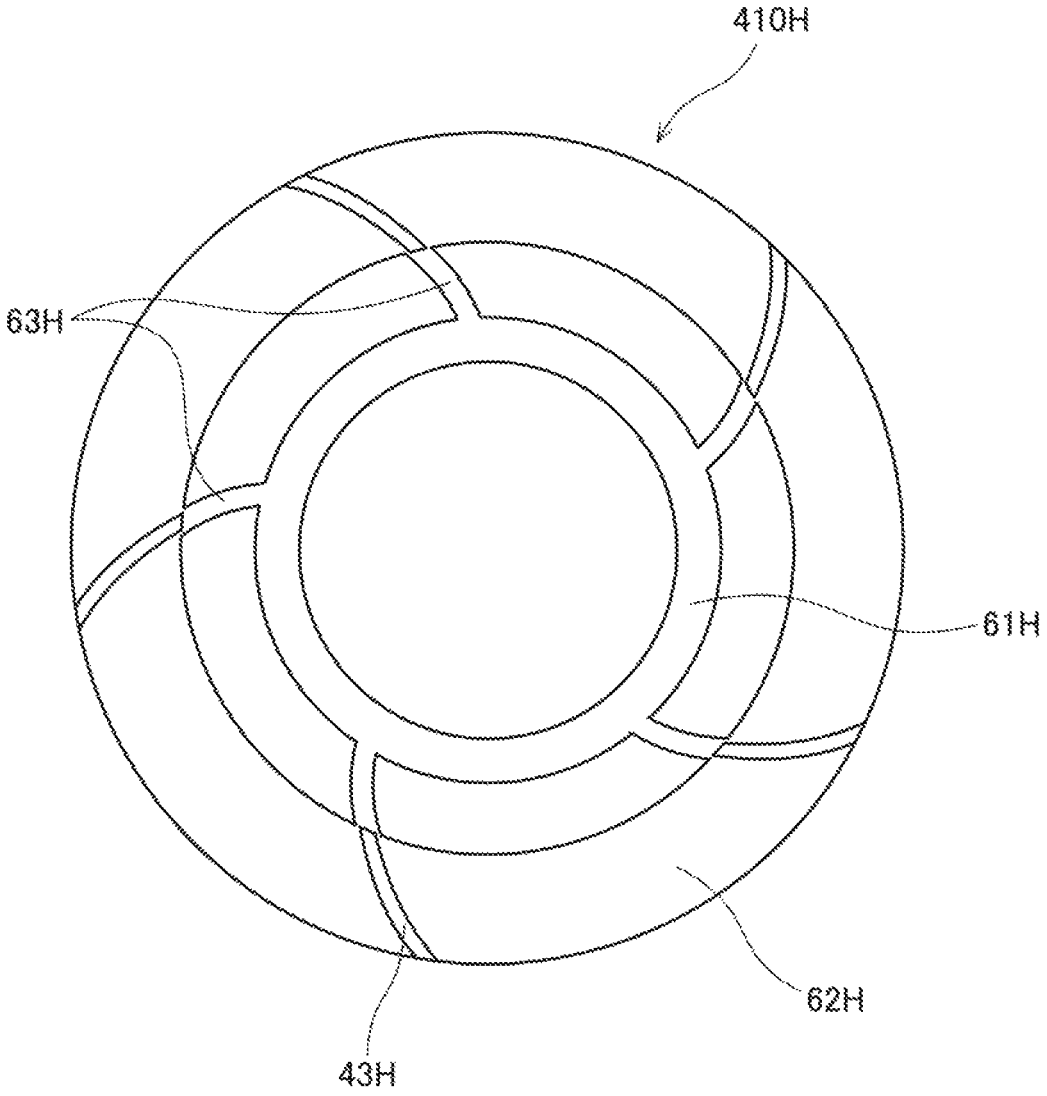
FIG. 15 is a top view of a plurality of flat plates of a blower apparatus according to a modification of the first preferred embodiment.

FIG. 15 is a top view of a plurality of flat plates 410H of a blower apparatus according to yet another modification of the above-described preferred embodiment. In the blower apparatus according to the modification illustrated in FIG. 15, each of the flat plates 410H includes, in an upper surface thereof, a plurality of guide portions 43H spaced from one another in the circumferential direction. Each of the guide portions 43H is a protruding portion defined in the upper surface of the corresponding flat plate 410H. Note that each guide portion 43H may alternatively be a recessed portion.

In the blower apparatus according to the modification illustrated in FIG. 15, each guide portion 43H is arranged on a radially outer extension of a rib 63H. When the guide portion 43H is arranged on the extension of the rib 63H, an air flow traveling radially outward from the vicinity of the rib 63H can be guided effectively. This contributes to more effectively preventing a turbulent flow from occurring in the vicinity of the rib 63H, which leads to a further improvement in air blowing efficiency of the blower apparatus.

Since a stress is applied to a junction of each rib 63H and an outer annular portion 62H, it is preferable that rigidity of a portion of the flat plate 410H at and near the junction is increased. Accordingly, the guide portion 43H, which is the protruding portion, is arranged in the vicinity of the junction to improve the rigidity of the portion of the flat plate 410H at and near the junction. This leads to increased durability of the flat plate 410H.

Figure 16:
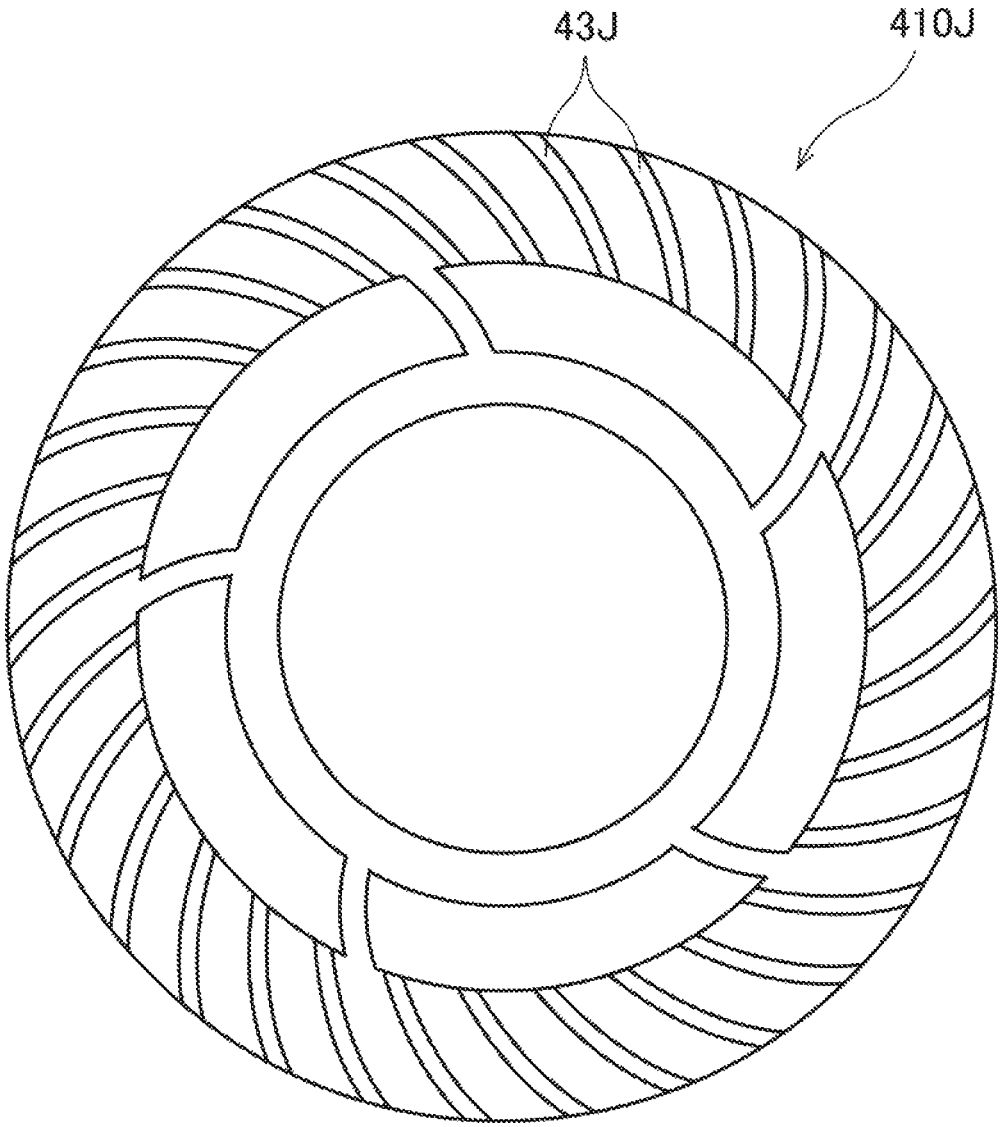
FIG. 16 is a top view of a plurality of flat plates of a blower apparatus according to a modification of the first preferred embodiment.

FIG. 16 is a top view of a plurality of flat plates 410J of a blower apparatus according to yet another modification of the above-described preferred embodiment. In the blower apparatus according to the modification illustrated in FIG. 16, each of the flat plates 410J includes, in an upper surface thereof, a plurality of guide portions 43J spaced from one another in the circumferential direction. Each of the guide portions 43J is a protruding portion defined in the upper surface of the corresponding flat plate 410J. Note that each guide portion 43J may alternatively be a recessed portion.

In the blower apparatus according to the modification illustrated in FIG. 16, the guide portions 43J are arranged at regular intervals in the circumferential direction. It is assumed here that the wording "regular intervals" includes "substantially regular intervals". This allows each flat plate 410J to maintain an excellent weight balance in the circumferential direction. This in turn allows an air blowing portion including the flat plates 410J to stably rotate. Thus, a reduction in noise generated by the air blowing portion can be achieved.

Figure 17:
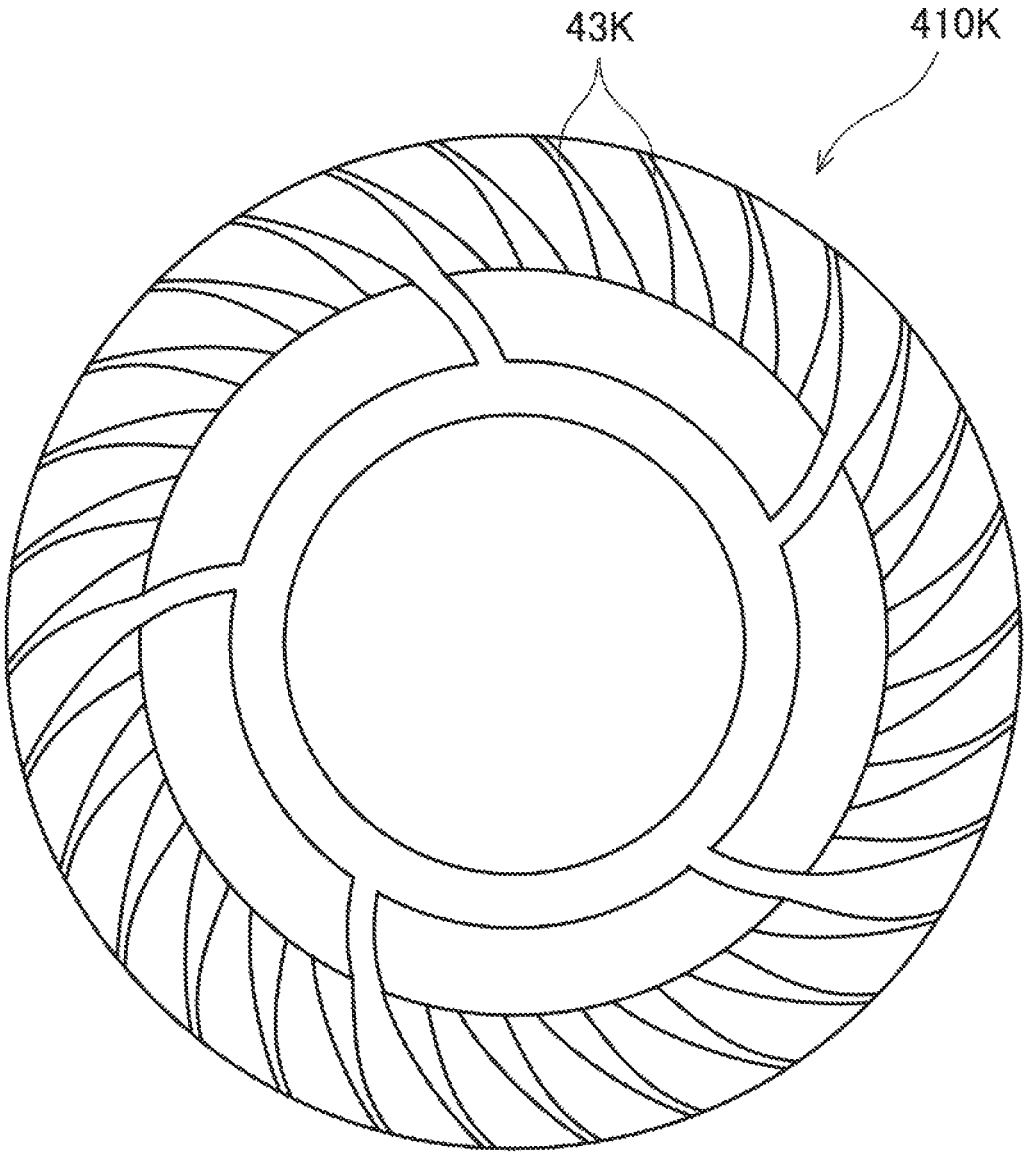
FIG. 17 is a top view of a plurality of flat plates of a blower apparatus according to a modification of the first preferred embodiment.

FIG. 17 is a top view of a plurality of flat plates 410K of a blower apparatus according to yet another modification of the above-described preferred embodiment. In the blower apparatus according to the modification illustrated in FIG. 17, each of the flat plates 410K includes, in an upper surface thereof, a plurality of guide portions 43K spaced from one another in the circumferential direction. Each of the guide portions 43K is a protruding portion defined in the upper surface of the corresponding flat plate 410K.

In the blower apparatus according to the modification illustrated in FIG. 17, each of the guide portions 43K is arranged to gradually decrease in circumferential width in a radially outward direction. When each of the guide portions 43K is the protruding portion as mentioned above, a space between circumferentially adjacent ones of the guide portions 43K defines a main flow channel for an air flow in an axial gap defined between adjacent ones of the flat plates 410K. When the width of each guide portion 43K is arranged to decrease in the radially outward direction, the width of the above flow channel increases in the radially outward direction. Therefore, the width of the flow channel is relatively small on the radially inner side, and static pressure is therefore relatively high on the radially inner side. Meanwhile, the width of the flow channel is relatively large on the radially outer side, and the static pressure is therefore relatively low on the radially outer side. An air flow passing radially outward in this flow channel travels radially outward with great force. This leads to improvements in air volume and air blowing efficiency of the blower apparatus.

Figure 18:
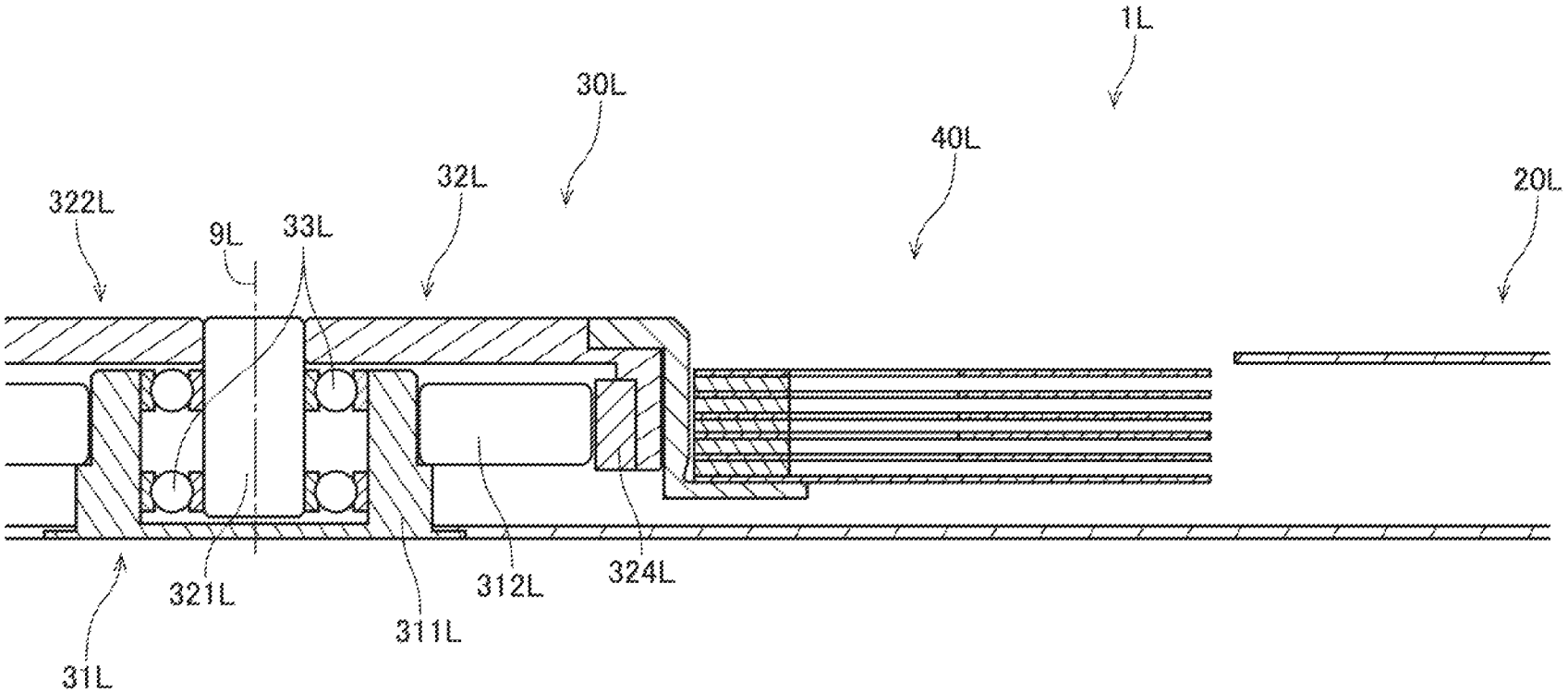
FIG. 18 is a partial sectional view of a blower apparatus according to a modification of the first preferred embodiment.

FIG. 18 is a partial sectional view of a blower-apparatus 1L according to yet another modification of the above-described preferred embodiment. In the blower apparatus 1L according to the modification illustrated in FIG. 18, a motor portion 30L includes a stationary portion 31L, a rotating portion 32L, and two ball bearings 33L.

The stationary portion 31L includes a stator fixing portion 311L and a stator 312L. The stator fixing portion 311L is a member being cylindrical and having a closed bottom and fixed to a housing 20L. The stator 312L is an armature fixed to an outer circumferential surface of the stator fixing portion 311L.

The rotating portion 32L includes a shaft 321L, a hub 322L, and a magnet 324L. At least a lower end portion of the shaft 321L is arranged inside of the stator fixing portion 311L. In addition, an upper end portion of the shaft 321L is fixed to the hub 322L. The magnet 324L is fixed to the hub 322L. The magnet 324L is arranged radially opposite to the stator 312L.

Each ball bearing 33L is arranged to connect the rotating portion 32L to the stationary portion 31L such that the rotating portion 32L is rotatable with respect to the stationary portion 31L. Specifically, an outer race of each ball bearing 33L is fixed to an inner circumferential surface of the stator fixing portion 311L of the stationary portion 31L. In addition, an inner race of each ball bearing 33L is fixed to an outer circumferential surface of the shaft 321L of the rotating portion 32L. Further, a plurality of balls, each of which is a spherical rolling element, are arranged between the outer race and the inner race. As described above, instead of a fluid dynamic bearing, rolling-element bearings, such as, for example, ball bearings, may be used as a bearing structure of the motor portion 30L.

In the modification illustrated in FIG. 18, the motor portion 30L includes the two ball bearings 33L. The ball bearings 33L are arranged near an upper end and a lower end of an axial range over which the inner circumferential surface of the stator fixing portion 311L and the shaft 321L are opposed to each other. This contributes to preventing the shaft 321L from being inclined with respect to a central axis 9L.

Figure 19:
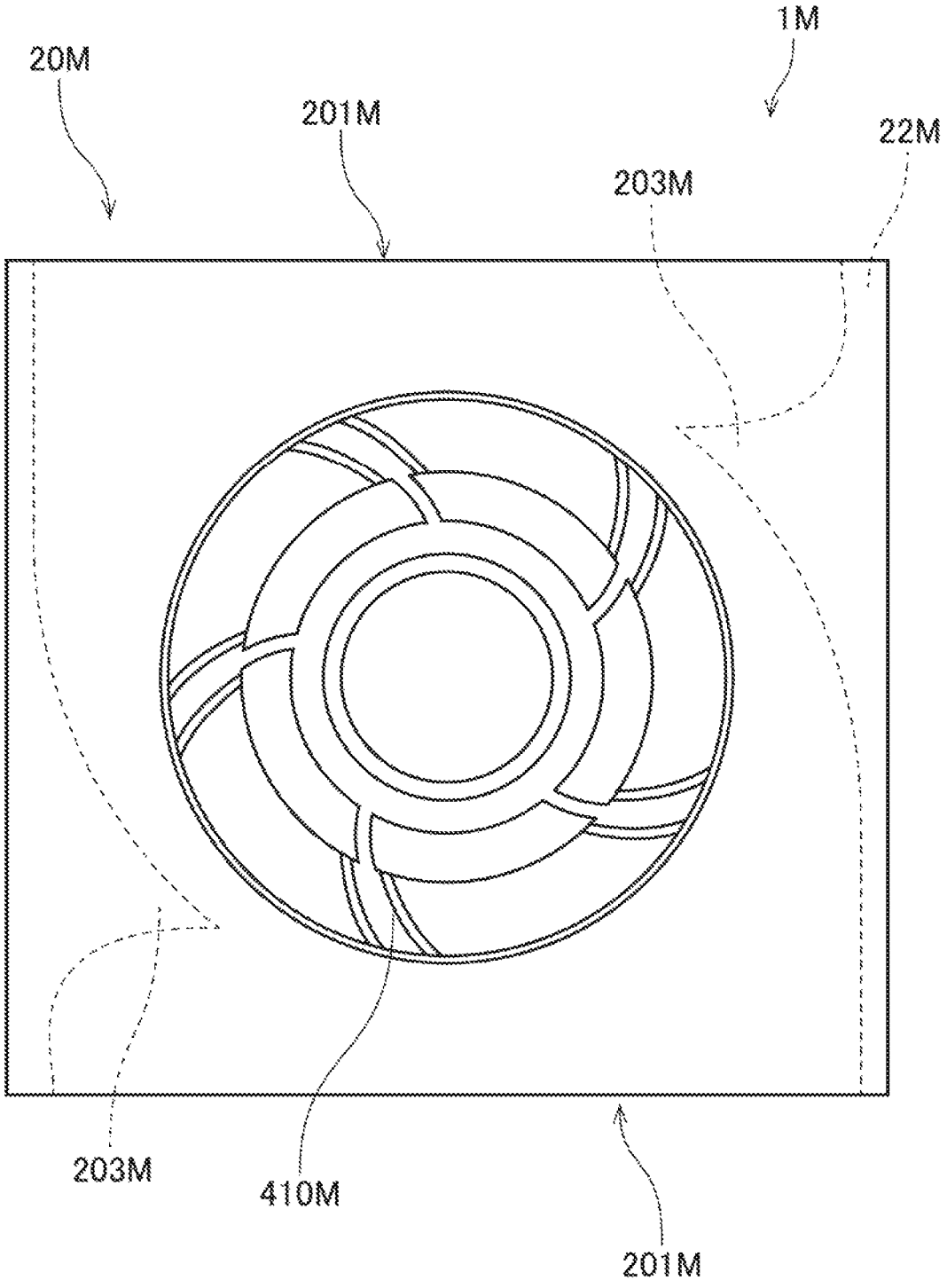
FIG. 19 is a top view of a blower apparatus according to a modification of the first preferred embodiment.

FIG. 19 is a top view of a blower apparatus 1M according to yet another modification of the above-described preferred embodiment. In the blower apparatus 1M according to the modification illustrated in FIG. 19, a housing 20M includes a plurality of air outlets 201M. Specifically, a side wall portion 22M includes the air outlets 201M, each of which is arranged to face in a radial direction, at a plurality of circumferential positions. The housing 20M includes tongue portions 203M, each of which is arranged near a separate one of the air outlets 201M. In addition, an air blowing portion 40M includes a plurality of flat plates 410M arranged in the axial direction with an axial gap defined between adjacent ones of the flat plates 410M.

In a centrifugal fan including an impeller, periodic noise occurs owing to the shape, number, arrangement, and so on of blades. In addition, such noise tends to easily occur around a tongue portion. Accordingly, when air is to be discharged in a plurality of directions, a deterioration in noise characteristics occurs because of an increased number of tongue portions. However, in this blower apparatus 1M, air flows traveling radially outward are generated by rotation of the flat plates 410M, and therefore, the blower apparatus 1M is able to achieve reduced periodic noise when compared to the centrifugal fan including the impeller. Therefore, the blower apparatus 1M, which is designed to discharge air in a plurality of directions, does not significantly deteriorate in noise characteristics due to the tongue portions 203M.

Note that, although the number of flat plates included in the air blowing portion is six in each of the above-described preferred embodiment and the modifications thereof, this is not essential to the present invention. The number of flat plates may alternatively be two, three, four, five, or more than six.

Also note that, although the hub is defined by two members, i.e., the hub body member and the flange member, in each of the above-described preferred embodiment and the modifications thereof, this is not essential to the present invention. The hub may alternatively be defined by a single member, or three or more members.

Also note that the detailed shape of any member may be different from the shape thereof as illustrated in the accompanying drawings of the present application. For example, the shape of any of the housing, the air blowing portion, and the motor portion may be different from that according to each of the above-described preferred embodiment and the modifications thereof. Also note that features of the above-described preferred embodiment and the modifications thereof may be combined appropriately as long as no conflict arises.

Preferred embodiments of the present invention are applicable to blower apparatuses.

While preferred embodiments of the present invention have been described above, it is to be understood that, variations and modifications will be apparent to those skilled in the art without departing from the scope and spirit of the present invention. The scope of the present invention, therefore, is to be determined solely by the following claims.

What is claimed is:

1. A blower apparatus comprising:

an air blowing portion arranged to rotate about a central axis extending in a vertical direction;

a motor portion arranged to rotate the air blowing portion; and a housing arranged to house the air blowing portion and the motor portion; wherein the housing includes:

an air inlet arranged above the air blowing portion, and arranged to pass through a portion of the housing in an axial direction; and an air outlet arranged to face in a radial direction at at least one circumferential position radially outside of the air blowing portion;

the air blowing portion includes a plurality of flat plates arranged in the axial direction with an axial gap defined between adjacent ones of the flat plates;

at least one of the flat plates includes, in at least one of an upper surface and a lower surface thereof, a plurality of guide portions spaced from one another in a circumferential direction; and each of the guide portions is a protruding portion or recessed portion arranged to extend in a radial direction.

2. The blower apparatus according to claim 1, wherein each of the flat plates includes the guide portions in at least, one of the upper and lower surfaces thereof.

3. The blower apparatus according to claim 1, wherein the air blowing portion is arranged to rotate to one side in the circumferential direction along with rotation of the motor portion; and each of the guide portions is arranged to curve to an opposite side in the circumferential direction as the guide portion extends radially outward.

4. The blower apparatus according to claim 1, wherein each of the guide portions is a protruding portion arranged to gradually decrease in circumferential width in a radially outward direction.

5. The blower apparatus according to claim 1, wherein at least one of the flat plates includes:

an inner annular portion being annular, and centered on the central axis;

an outer annular portion being annular, centered on the central axis, and arranged radially outside of the inner annular portion;

a plurality of ribs each of which is arranged to radially join the inner annular portion and the outer annular portion to each other;

a plurality of air holes each of which is surrounded by the inner annular portion, the outer annular portion, and two circumferentially adjacent ones of the ribs, and is arranged to pass through the flat plate in the axial direction; and the guide portions;

each of the ribs is arranged to extend in the radial direction while curving; and each of the guide portions is arranged to extend in the radial direction with a curvature equal to a curvature with which each of the ribs is arranged to extend in the radial direction.

6. The blower apparatus according to claim 5, wherein a circumferential distance between a radially outer end of each of the ribs and a radially inner end of each of the guide portions circumferentially adjacent to the rib is arranged to be smaller than a circumferential distance between radially inner ends of every two circumferentially adjacent ones of the guide portions.

7. The blower apparatus according to claim 6, wherein two of the guide portions are arranged on both circumferential sides of the radially outer end of each of the ribs.

8. The blower apparatus according to claim 5, wherein each of the guide portions is arranged on a radially outer extension of a corresponding one of the ribs.

9. The blower apparatus according to claim 1, wherein the guide portions are arranged at regular intervals in the circumferential direction.

10. The blower apparatus according to claim 1, wherein a surface of each of the guide portions is arranged to be curved in a cross-section perpendicular to a length of the guide portion.

11. The blower apparatus according to claim 1, wherein a center of the air inlet is arranged to coincide with the central axis.

12. The blower apparatus according to claim 1, wherein the motor portion includes:

a stationary portion including an armature and a bearing housing; and a rotating portion including a shaft, a bearing member, and a magnet arranged radially opposite to the armature;

the bearing housing and a combination of the shaft and the bearing member are arranged to have a lubricating fluid therebetween;

the bearing housing and the rotating portion are arranged to together define a gap defining a seal portion therebetween, the seal portion having a surface of the lubricating fluid defined therein; and in the seal portion, a distance between the bearing housing and the rotating portion is arranged to increase with increasing distance from the surface of the lubricating fluid.

13. The blower apparatus according to claim 1, wherein the motor portion includes:

a stationary portion including an armature;

a rotating portion including a magnet arranged radially opposite to the armature; and a ball bearing arranged to connect the rotating portion to the stationary portion such that the rotating portion is rotatable with respect to the stationary portion.

14. The blower apparatus according to claim 1, wherein the housing includes a plurality of the air outlets at a plurality of circumferential positions.

* * * * *